US008584660B2

(12) United States Patent
Hall

(10) Patent No.: US 8,584,660 B2
(45) **Date of Patent: *Nov. 19, 2013**

(54) PAINTBALL SYSTEM

(76) Inventor: David L. Hall, South Salt Lake, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/355,334

(22) Filed: Jan. 20, 2012

(65) Prior Publication Data

US 2012/0180771 A1 Jul. 19, 2012

Related U.S. Application Data

(63) Continuation of application No. 11/391,947, filed on Mar. 29, 2006, now Pat. No. 8,100,119.

(60) Provisional application No. 60/680,898, filed on May 13, 2005, provisional application No. 60/724,172, filed on Oct. 6, 2005.

(51) Int. Cl.
*F41B 11/00* (2013.01)

(52) U.S. Cl.
USPC ..... 124/71; 124/51.1

(58) Field of Classification Search
USPC ..... 124/71, 51.1
See application file for complete search history.

(56) References Cited

U.S. PATENT DOCUMENTS

| | | | | | |
|---|---|---|---|---|---|
| 2,725,868 | A * | 12/1955 | Foster | 124/65 |
| 3,410,453 | A * | 11/1968 | Lawrence | 221/175 |
| 3,802,407 | A * | 4/1974 | Imazu | 124/59 |
| 3,838,676 | A * | 10/1974 | Kahelin | 124/75 |
| 4,212,284 | A * | 7/1980 | Speer | 124/56 |
| 5,505,188 | A * | 4/1996 | Williams | 124/74 |
| 5,839,422 | A * | 11/1998 | Ferris | 124/53.5 |
| 6,055,975 | A * | 5/2000 | Gallagher et al. | 124/50 |
| 6,957,645 | B1 * | 10/2005 | Cross | 124/51.1 |
| 6,981,493 | B1 * | 1/2006 | Poteracke | 124/51.1 |
| 2005/0274371 | A1 * | 12/2005 | Lubben | 124/51.1 |
| 2006/0081233 | A1 * | 4/2006 | Andresen | 124/51.1 |
| 2006/0130821 | A1 * | 6/2006 | Hamilton | 124/51.1 |
| 2007/0017494 | A1 * | 1/2007 | Andresen | 124/51.1 |
| 2007/0017495 | A1 * | 1/2007 | Andresen | 124/51.1 |
| 2007/0107711 | A1 * | 5/2007 | Leal et al. | 124/71 |
| 2008/0047537 | A1 * | 2/2008 | Kulp et al. | 124/51.1 |
| 2008/0105245 | A1 * | 5/2008 | Cole | 124/77 |
| 2008/0236558 | A1 * | 10/2008 | Bosch et al. | 124/48 |
| 2009/0056691 | A1 * | 3/2009 | Christopher et al. | 124/51.1 |
| 2009/0133680 | A1 * | 5/2009 | Christopher et al. | 124/51.1 |
| 2009/0178659 | A1 * | 7/2009 | Spicer | 124/51.1 |

* cited by examiner

*Primary Examiner* — Samir Abdosh
(74) *Attorney, Agent, or Firm* — Maschoff Brennan

(57) ABSTRACT

A paintball system may include a marker and delivery system configured to deliver paintballs to the marker. The delivery system may include a conduit and a gas supply. The gas supply may be configured to provide gas flow to the conduit, which may propel paintballs in the conduit to the marker. The gas supply may be configured to dynamically alter the gas flow to the conduit. The delivery system may include a first seal sized and configured to form a seal with at least one of the paintballs in the conduit.

19 Claims, 15 Drawing Sheets

PAINTBALL SYSTEM

CROSS-REFERENCE TO RELATED APPLICATIONS

This application is a continuation of U.S. utility patent application Ser. No. 11/391,947 entitled PAINTBALL SYSTEM, which was filed Mar. 29, 2006. This application also claims priority to, and the benefit of, U.S. provisional patent application Ser. No. 60/680,898, which was filed May 13, 2005. This also application claims priority to, and the benefit of, U.S. provisional patent application Ser. No. 60/724,172, which was filed Oct. 6, 2005. The disclosures of these applications are incorporated by reference.

BACKGROUND OF THE INVENTION

1. Field of the Invention

The present invention generally relates to sporting equipment and, more particularly, to paintball systems.

2. Description of Related Art

Paintball games have become very popular. In conventional paintball games, the object is to hit your opponent with a paintball and have the paintball break upon impact—thereby marking the opponent and removing them from the game. Paintball games may be played in a variety of locations, both indoors and outdoors. Persons may participate in paintball games as individuals or as a member of a team. Many civilians may play paintball games for recreation and sport, while military personnel may play paintball games as part of their training.

Conventional paintballs are generally spherical and typically include a shell that encapsulates a marking substance. The marking substance (typically referred to as "paint")=may include any of a variety of substances configured to leave a mark. One exemplary marking substance comprises vegetable oil, water and a coloring agent. Conventional shells are typically relatively thin and configured to break upon impact, allowing the marking substance to mark an opponent.

Conventional paintball systems may include a gun or marker configured to fire paintballs, for example, at an opponent. Conventional paintball systems may also include a hopper connected to the marker. The hoppers are typically mounted on an upper portion of the marker. Some conventional hoppers are configured to load paintballs into the marker using gravity. Other conventional hoppers are configured to load paintballs into the marker using a mechanical pump and/or gravity.

When selecting a hopper, players typically must compromise between paintball capacity and hopper size. Advantageously, a smaller hopper may present a smaller potential target for opponents to hit and may be less obstructive to a player's view. Because a smaller hopper may have smaller paintball capacities, a player may have to repeatedly refill the small hopper. Unfortunately, players may be more vulnerable targets while refilling their hoppers. To minimize this vulnerability, players often hastily refill their hoppers, wasting many paintballs that spill to the ground. In contrast to the smaller hoppers, the larger hoppers may have larger paintball capacities, advantageously reducing the number of times players must refill their hoppers. Unfortunately, a larger hopper may present a larger potential target for opponents to hit and may be more obstructive to a player's view. Further, because the larger hoppers may have larger paintball capacities, the hoppers may disadvantageously weigh more when filled with paintballs—making it more tiresome for a the hopper and the marker.

Players typically prefer markers with higher firing rates in order to shoot more paintballs in less time, which may increase their chances of hitting a target such as an opponent. In fact, marker firing rate can be a very important factor in a marker purchase. Consequently, many marker manufacturers tout their marker's firing rate, which is often their marker's "dry" firing rate (that is, the firing rate without any paintballs actually being loaded into the marker).

However, to fire a paintball in practice, the marker typically must wait for the paintball to be loaded into the marker (sometimes called "drop time") and for the paintball to settle in the marker (sometimes called "paintball debounce time"). In particular, if the marker is fired before the paintball is properly loaded and settled, a bolt of the marker could break the paintball. This breakage could create a mess requiring substantial cleaning before the marker could properly function (or even function at all). During a competitive paintball game, players may not have sufficient time to clean up such a mess. And, even if the players had sufficient time, the players would be more vulnerable targets while cleaning their systems. Consequently, this paintball breakage would leave players with two poor alternatives: playing with an improperly functioning (or non-functioning) paintball system or cleaning their paintball systems with a higher risk of being hit by an opponent.

Waiting for the drop time and/or the bounce time associated with a particular hopper or other loading system may disadvantageously reduce a marker's effective firing rate. Unfortunately, the drop times and/or the debounce times associated with some conventional hoppers may be relatively long. Further, because the drop times for some conventional hoppers may vary significantly, a marker may have to wait for a drop time that accommodates all or most of those varied drop times in order to eliminate or reduce the risk of unintentional paintball breakage.

BRIEF SUMMARY OF EMBODIMENTS OF THE INVENTION

A need therefore exists for a paintball system that eliminates or diminishes the disadvantages and problems described above.

One aspect is a paintball system that may include a marker and delivery system configured to deliver paintballs to the marker. The delivery system may include a conduit and a gas supply. The gas supply may be configured to provide gas flow to the conduit to propel paintballs in the conduit to the marker.

Another aspect is a delivery system that may include a conduit sized and configured to transmit paintballs. The delivery system may also include a gas supply configured to provide gas flow to the conduit. The delivery system may further include a first seal sized and configured to form a seal with at least one of the paintballs. The gas supply may be configured to dynamically decrease the gas flow to the conduit, for example, as pressure increases downstream from the gas supply and/or upstream from the seal formed by the first seal. Decreasing the gas flow may advantageously help prevent or reduced unintentional breakage of paintballs in the conduit and may help reduce the size, weight and/or cost of the delivery system.

Yet another aspect is a delivery system that may include a conduit sized and configured to align a plurality of paintballs in a single-file line. The delivery system may also include a gas supply configured to provide gas flow to the conduit. The gas flow may exert a force against paintballs in the conduit, which may cause the paintballs to stack together in a single-file line from, for example, a breech of a marker or an interior portion of a hopper. The delivery system may also include a first seal sized and configured to form a seal with at least one of the paintballs in the stack of paintballs. One or more paintballs in the stack may be positioned downstream from the first seal and may resist the force exerted against the paintballs, thus helping to preserve the seal formed by the first seal.

Still another aspect is a delivery system that may include a conduit and a gas supply configured to provide gas flow to the conduit, which may cause the paintballs in the conduit to stack together in a single-file line from a breech of a marker. The delivery system may also include a first seal sized and configured to form a seal with at least one of the paintballs in the stack of paintballs. One or more paintballs in the stack may be positioned downstream from the first seal and may resist the force exerted against the paintballs, thus helping to preserve the seal formed by the first seal. When the paintball in the breech is fired from the marker, the paintballs in the stack may quickly reload the breech, which may help reduce the drop time and/or the bounce time and thus may advantageously help increase the marker's effective firing rate. In addition, when the paintball in the breech is fired from the marker, the paintballs in the stack may consistently reload the breech, which may also help increase the marker's effective firing rate.

Another aspect is delivery system that may include a conduit, which may include a plurality of storage tubes sized and configured to store a plurality of paintballs and a manifold configured to receive the paintballs from the plurality of storage tubes. The delivery system may also include a gas supply configured to selectively provide gas flow to the storage tubes.

Yet another aspect is a delivery system that may include a conduit, which may include a plurality of plates. The plates may include grooves and/or passageways, and the grooves and the passageways of the plates may be aligned to form one or more passageways sized and configured to contain and/or transmit paintballs. The grooves may be formed on an upper portion of the plate, a lower portion of the plate, or both.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards paintball systems. The principles of the present invention, however, are not limited to paintball systems. It will be understood that, in light of the present disclosure, the paintball system disclosed herein can be successfully used in connection with other types of marking systems, projectile systems, and the like.

Additionally, to assist in the description of the paintball system, words such as top, bottom, front, rear, right and left may be used to describe the accompanying figures, which are not necessarily drawn to scale. It will be appreciated, however, that the paintball system can be located in a variety of desired positions—including various angles, sideways and even upside down. A detailed description of the paintball system now follows.

Figure 1:
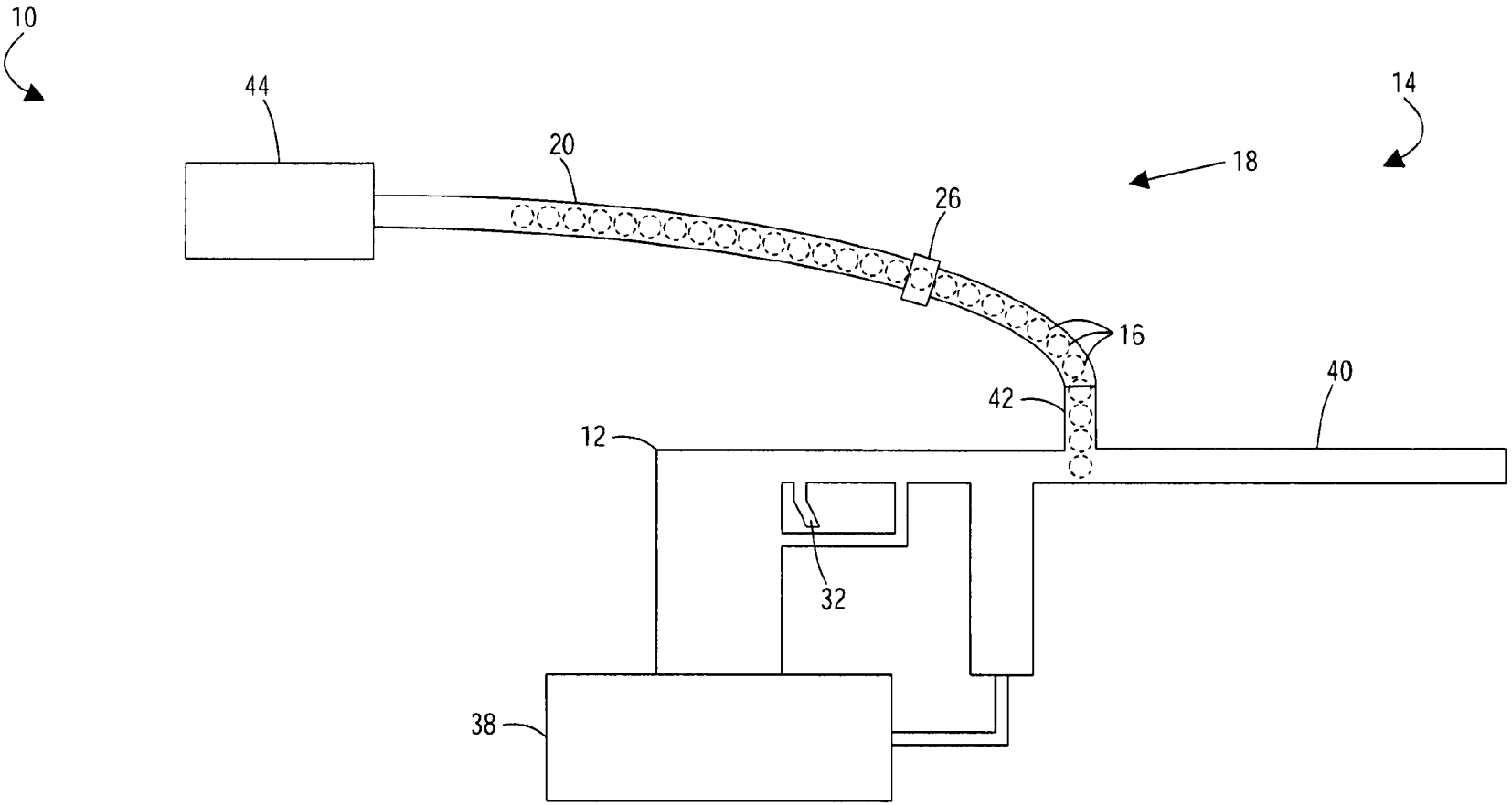
FIG. 1 is a diagram of an exemplary paintball system, illustrating an exemplary marker and an exemplary delivery system including a gas supply and a conduit.
Figure 2:
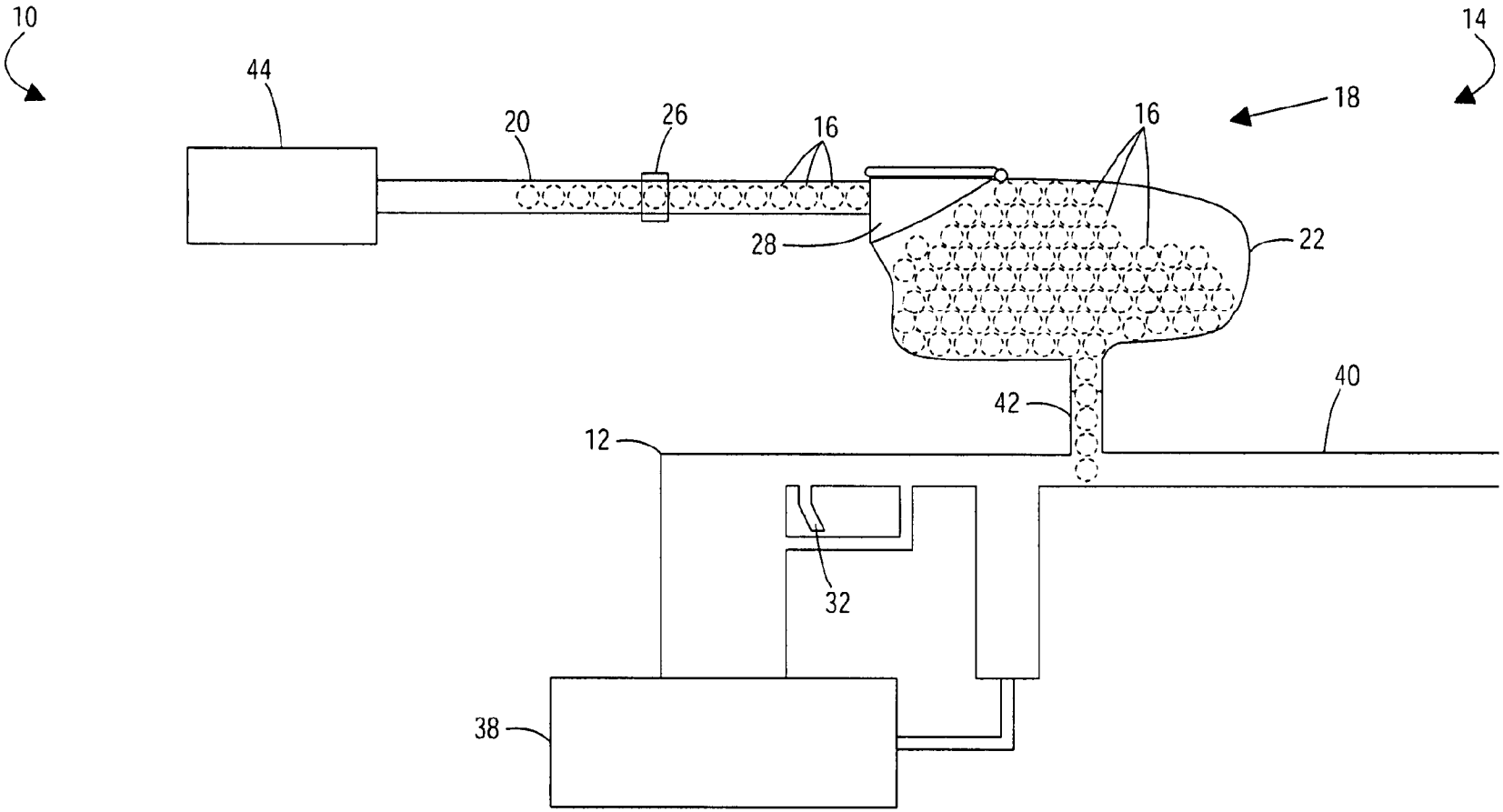
FIG. 2 is a diagram of the paintball system shown in FIG. 1, illustrating the conduit including an exemplary hopper.
Figure 3:
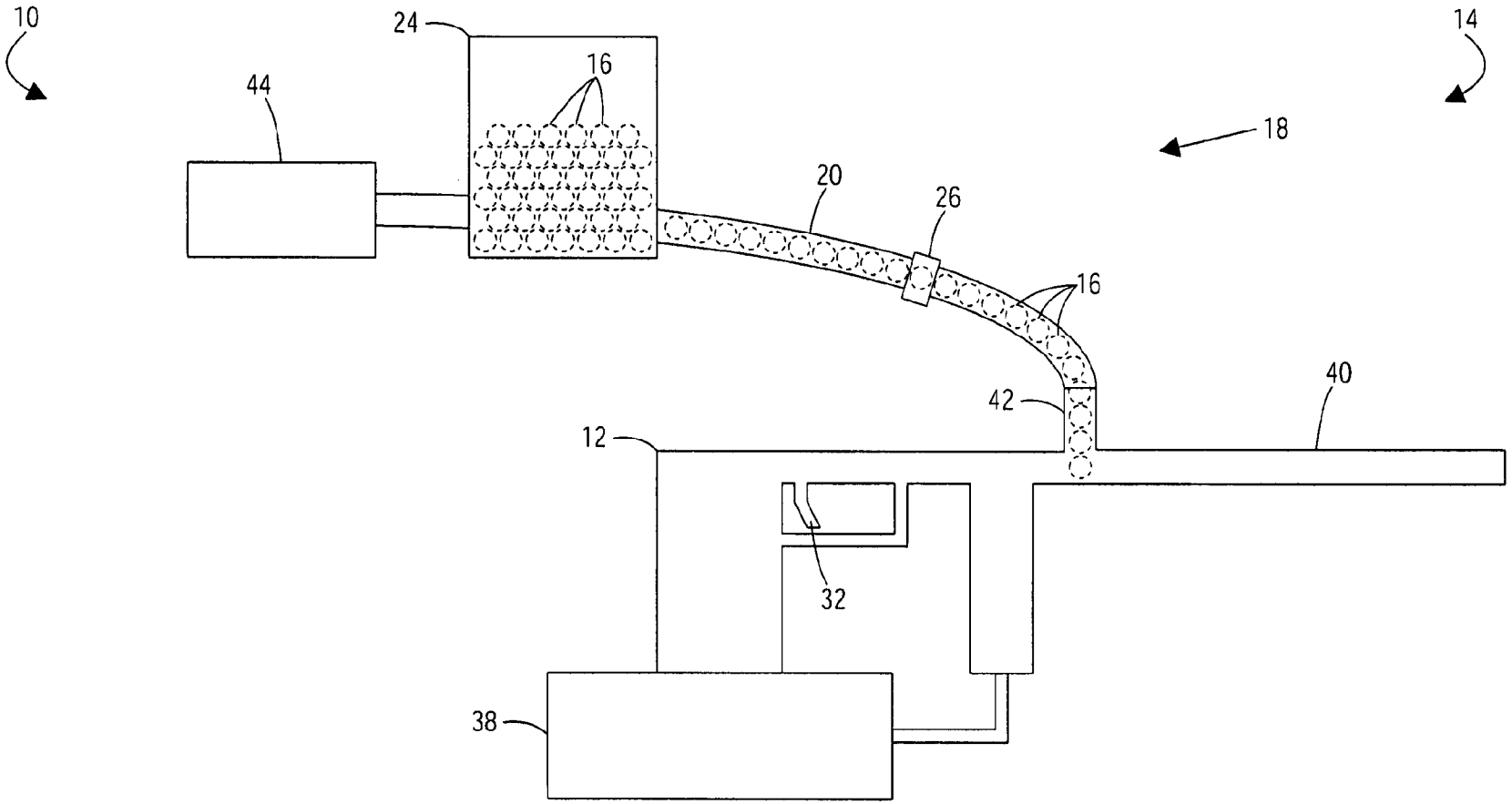
FIG. 3 is a diagram of the paintball system shown in FIG. 1, illustrating the conduit including an exemplary container.

As shown in FIGS. 1-3, a paintball system 10 may include a gun or marker 12 and a delivery system 14. The delivery system 14 may deliver one or more projectiles (such as paintballs 16) to the marker 12. The marker is advantageously configured to fire paintballs, for example, at an opponent or other target.

The paintballs 16 preferably include a shell that encapsulates a marking substance, and the paintballs are preferably generally spherical. The shell is preferably sized and configured to break upon impact against a target, such as an opponent. In one embodiment, the marking substance may comprise vegetable oil, water and at least one coloring agent. It will be appreciated, however, that the marking substance may comprise any suitable substance configured to leave a mark.

The paintball system 10 is preferably portable and relatively lightweight. For example, components of the delivery system 14 desirably may be carried in a backpack or another suitable manner. It will be appreciated, however, that the paintball system 10 need not be portable or lightweight depending, for example, upon the particular configuration and/or use of the paintball system. For example, because consumers often find marker firing rate an important factor in purchasing a marker, a marker manufacturer may benefit substantially from using the delivery system 14 to conduct tests to demonstrate to their consumers that their marker has a superior firing rate. Also, for example, in mock war games, the paintball system 10 may be fixed to a vehicle or a bunker. In such instances, portability and/or weight of the paintball system 10 may not be a concern. Consequently, the components of the paintball system 10 may be relatively heavy in such instances. For example, the paintball system 10 may use a relatively heavy air pump (such as a shop compressor) to provide gas flow.

The delivery system 14 may include a conduit 18, which is preferably sized and configured to contain and/or transmit paintballs 16. The conduit 18 is preferably sized and configured to contain and/or transmit a sufficient amount of paintballs to last for an entire paintball game; however, the conduit may have any other suitable size and configuration.

As shown in FIGS. 1-3, the conduit 18 may include one or more tubes 20, one or more hoppers 22, one or more containers 24, and/or other structures that may contain and/or transmit paintballs. The conduit 18 may include one or more seals 26, which may be sized and configured to create a seal with at least one paintball. The conduit 18 may include one or more connectors or adapters sized and configured to interconnect components of the conduit. For example, as shown in FIG. 2, the conduit may include an adapter 28 that may be sized and configured to interconnect the tube 20 and the hopper 22. If desired, the adapter 28 may form part of the hopper 22. It will be appreciated that a conduit (such as the conduit 18) may include a variety of other suitable structures having other suitable sizes, shapes and configurations. It will be further appreciated that a conduit may consist of a single integrally formed structure or may comprise a plurality of separately formed structures depending, for example, upon the particular configuration of the conduit.

Figure 5:
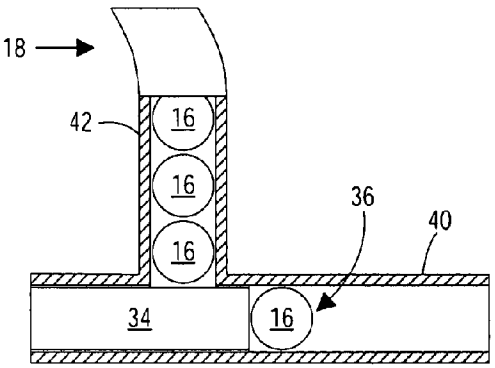
FIG. 5 is a cross sectional view of a portion of the paintball system shown in FIG. 1, illustrating a paintball in a firing chamber of the marker.
Figure 4:
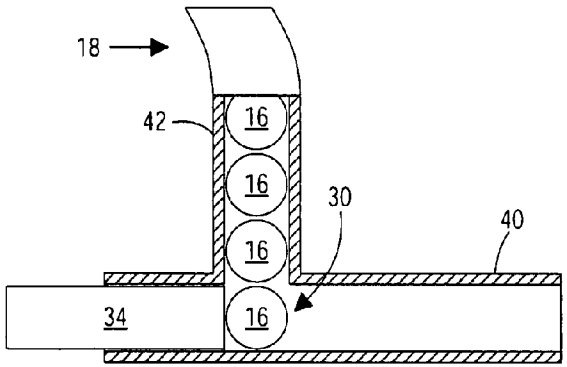
FIG. 4 is a cross sectional view of a portion of the paintball system shown in FIG. 1, illustrating a paintball in a breech of the marker.
Figure 7:
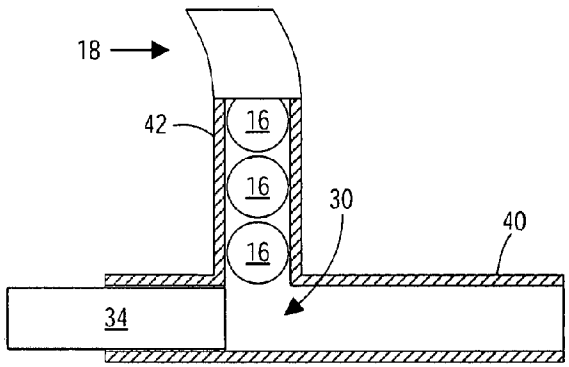
FIG. 7 is a cross sectional view of a portion of the paintball system shown in FIG. 1, illustrating a bolt positioned to allow a paintball to enter a breech of the marker.
Figure 6:
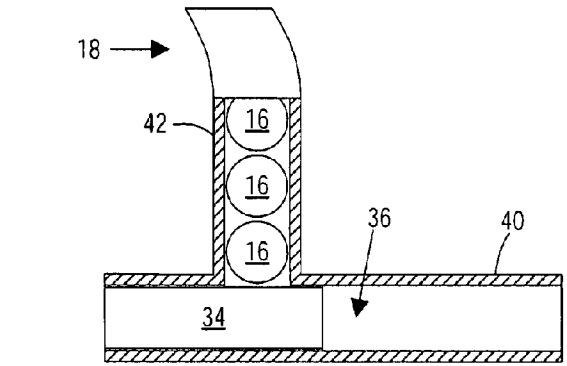
FIG. 6 is a cross sectional view of a portion of the paintball system shown in FIG. 1, illustrating a paintball fired from the firing chamber.

As shown in FIGS. 1-7, the conduit 18 may advantageously help transmit the paintballs 16 to a breech 30 of the marker 12, which may prepare the marker for firing. When a trigger 32 of the marker 12 is pulled, a bolt 34 of the marker may extend forward, closing the breech 30 and pushing a paintball 16 into a firing chamber 36 of the marker (as shown in FIG. 5); the firing chamber may be pressurized with gas supplied from a gas supply 38 that propels the paintball 16 out of a barrel 40 of the marker (as shown in FIG. 6); and the bolt 34 may retreat to allow the next paintball 16 to enter the breech 30 from, for example, a feed tube 42 of the marker (as shown in FIG. 7). It will be appreciated that the marker 12 does not require the feed tube 42 (or any other particular component) and that the marker may include other suitable components, which may be configured to receive and fire a paintball in other suitable manners.

As shown in FIGS. 1-3, the delivery system 14 may also include a gas supply 44. The gas supply 44 may advantageously supply gas flow to the conduit 18 to help move one or more paintballs 16 from a first position to a second position (such as, from a first position in the conduit to a second position in the conduit; from a first position in the conduit to a second position in the marker 12; and from and to other positions). For example, as shown in FIG. 2, the gas supply 44 may supply gas flow to the conduit 18 to move the paintballs 16 from the tube 20 to the hopper 22. Also, for example, as shown in FIGS. 1-7, the gas supply 44 may supply gas flow to the conduit 18 to move the paintballs 16 from the conduit 18 to the breech 30. In one embodiment, the gas supply 44 may advantageously be configured to supply gas flow both to the conduit 18 and to the marker 12. Thus, it will be appreciated that the paintball system 10 does not require the gas supply 38, if desired.

Figure 8:
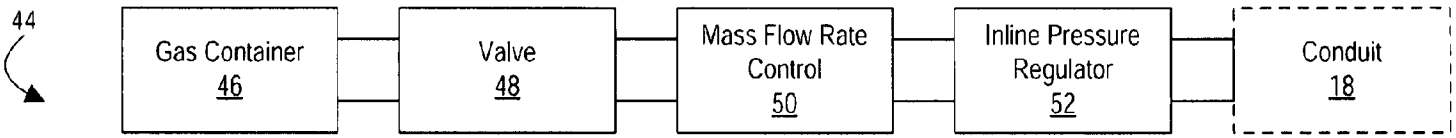
FIG. 8 is a diagram of an exemplary embodiment of the gas supply and the conduit shown in FIG. 1.

As shown in FIG. 8, the gas supply 44 may include a gas container 46 that may contain pressurized gas. The gas container 46 is preferably portable and preferably contains a relatively large amount of pressured gas. The gas supply 44 may also include a valve 48, a mass flow rate control 50, and an inline pressure regulator 52. The inline pressure regulator 52 preferably has an inlet and an outlet and may adjust the gas flow from inlet to outlet based on the pressure at its outlet. The valve 48 may be opened to allow pressurized gas to travel from the gas container 46 to the mass flow rate control 50, from the mass flow rate control to the inline pressure regulator 52, and from the inline pressure regulator to the conduit 18. The valve 48 may be configured to be controlled (e.g., opened or closed) using a remote control device (such as a switch, keypad, or other suitable control device) via wired or wireless connection. The valve 48 may also be configured to be controlled automatically, if desired. Further, the valve 48 may be configured to be physically operated and controlled.

Figure 9:
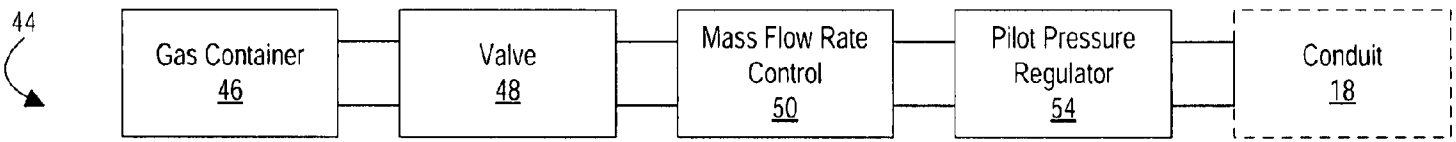
FIG. 9 is a diagram of another exemplary embodiment of the gas supply and the conduit shown in FIG. 1.

As shown in FIG. 9, the gas supply 44 may include the gas container 46, the valve 48, the mass flow rate control 50, and a pilot pressure regulator 54. The valve 48 may be opened to allow pressurized gas to travel from the gas container 46 to the mass flow rate control 50, from the mass flow rate control to the pilot pressure regulator 54, and from the pilot pressure regulator to the conduit 18.

Figure 10:
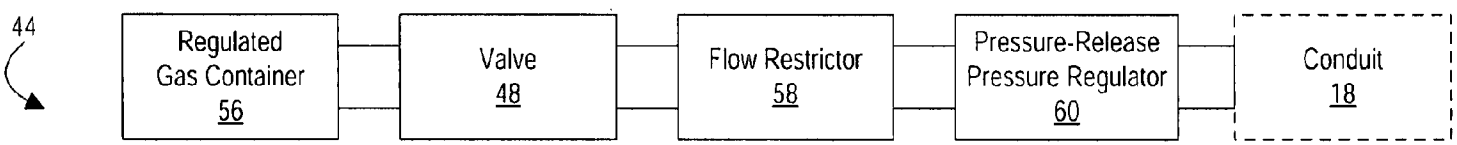
FIG. 10 is a diagram of yet another exemplary embodiment of the gas supply and the conduit shown in FIG. 1.

As shown in FIG. 10, the gas supply 44 may include a regulated gas container 56, the valve 48, a flow restrictor 58, and a pressure-release pressure regulator 60. The regulated gas container 56 advantageously includes an output pressure regulator. The flow restrictor 58 may comprise, for example, a needle valve. The valve 48 may be opened to allow pressurized gas to travel from the regulated gas container 56 to the flow restrictor 58, and from the flow restrictor to the conduit 18. The pressure-release pressure regulator 60 may be positioned downstream from the flow restrictor 58. If desired, one or more pressure-release pressure regulators 60 may be positioned at any suitable location along the conduit 18 or other suitable locations in the paintball system 10.

As shown in FIGS. 8-10, the gas supply 44 may advantageously provide a mass-flow-limited gas flow. In particular, the mass flow rate control 50 (FIGS. 8-9) and the flow restrictor 58 (FIG. 10) may be configured to control the mass flow rate of the pressurized gas to the conduit 18, which may help prevent or reduce unintentional breakage of the paintballs and which may help reduce the size, weight and/or cost of the paintball system 10. In further detail, as the mass flow rate of the pressurized gas to the conduit 18 increases, the velocity of a paintball 16 in the conduit may increase. Unfortunately, an excessive mass flow rate may cause a paintball 16 to move so fast that the paintball breaks when, for example, the paintball hits another paintball or hits the breech 30. This breakage could create a mess requiring substantial cleaning before the paintball system 10 could properly function (or even function at all). During a competitive paintball game, players may not have sufficient time to clean up such a mess. And, even if the players had sufficient time, the players would be more vulnerable targets while cleaning their systems. Consequently, this paintball breakage would leave players with two poor alternatives: playing with an improperly functioning (or non-functioning) paintball system or cleaning their paintball systems with a higher risk of being hit by an opponent. However, by limiting mass flow rate to the conduit 18, the mass flow rate control 50 and the flow restrictor 58 advantageously limit the velocity of the paintballs 16 to help prevent or reduce the risk of this breakage. The mass flow rate control 50 and the flow restrictor 58 preferably limit the mass flow rate to a maximum mass flow rate that is sufficiently high to allow the delivery system 14 to deliver paintballs to the marker 12 or the hopper 22 independent of the orientation of the marker or the hopper, and/or sufficiently low to prevent or reduce the risk of unintentional paintball breakage. Limiting the maximum mass flow rate may reduce the overall gas requirements of the paintball system 10, which may advantageously allow the paintball system to use gas containers (such as the gas containers 46, 56) that have a smaller size, a lower weight and/or a lower cost. It will be appreciated that a mass flow rate control or a flow restrictor may be configured to limit the mass flow rate to any desired maximum flow rate and that the desired maximum mass flow rate may depend, for example, upon the particular configuration and intended use of the paintball system 10. It will also be appreciated that a gas supply does not require any mass flow rate control or flow restrictor.

As shown in FIGS. 8-10, the gas supply 44 may advantageously provide a pressure-regulated gas flow. In particular, the inline pressure regulator 52, the pilot pressure regulator 54, and the pressure-release pressure regulator 60 may be configured to control the pressure in at least a portion of the conduit 18, which may help prevent or reduce unintentional breakage of the paintballs and which may help reduce the size, weight and/or cost of the paintball system 10. In further detail, excess pressure in the conduit 18 may cause a paintball to break, for example, against an adjacent paintball. As mentioned above, paintball breakage could create a mess that leaves players with two poor alternatives: playing with an improperly functioning (or non-functioning) paintball system or cleaning their paintball systems with a higher risk of being hit by an opponent. However, by limiting the pressure in at least a portion of the conduit 18, the inline pressure regulator 52, the pilot pressure regulator 54, and the pressure-release pressure regulator 60 may help prevent or reduce the risk of this breakage. The inline pressure regulator 52, the pilot pressure regulator 54, and the pressure-release pressure regulator 60 preferably limit the pressure to a maximum pressure sufficiently high to allow the delivery system 14 to deliver paintballs to the marker 12 or the hopper 22 independent of the orientation of the marker or the hopper, sufficiently high to reduce variability in paintball 16 drop times (which may help in providing increased marker firing rates), and/or sufficiently low to prevent or reduce the risk of unintentional paintball breakage. Limiting the maximum pressure may reduce the overall strength requirements of the conduit 18, which may advantageously allow the paintball system to use a conduit that has a smaller size, a lower weight and/or a lower cost. Limiting the maximum pressure may also improve performance consistency of the delivery system 14 when using a gas container that supplies different amounts of pressure as the gas container's pressure charge is spent. Limiting the maximum pressure may also reduce the overall gas requirements of the paintball system 10, which may advantageously allow the paintball system to use gas containers (such as the gas containers 46, 56) that have a smaller size, a lower weight and/or a lower cost. The pressure regulators 52, 54, 60 preferably limit the maximum pressure in at least a portion of the conduit 18 to a relatively low amount of pressure, such as, between about 1 psig to about 20 psig. It will be appreciated, however, that pressure regulators 52, 54, 60 may limit the maximum pressure to any other amounts of pressure. It will be further appreciated that a pressure regulator may be configured to limit the pressure to any desired maximum pressure and that the desired maximum pressure may depend, for example, upon the particular configuration and intended use of the paintball system 10. It will also be appreciated that a gas supply does not require any pressure regulator.

Figure 11:
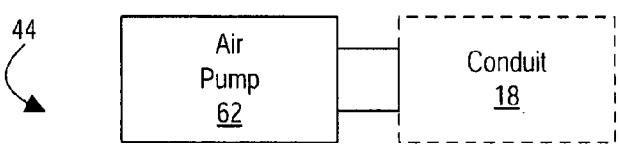
FIG. 11 is a diagram of still another exemplary embodiment of the gas supply and the conduit shown in FIG. 1.

As shown in FIG. 11, the gas supply 44 may include an air pump 62, which may be used to supply gas to the conduit 18. The air pump 62 is preferably motorized and may be started and stopped, as desired. Consequently, the air pump 62 need not include a valve 48. In addition, the air pump 62 may have a variable speed. The speed of the air pump 62 may be dynamically adjusted based upon gas pressure at one or more locations in the paintball system 10, based upon mass flow at one or more locations in the paintball system 10, based upon the presence of a paintball at one or more locations in the paintball system 10, and/or based upon any other suitable factors. It will be appreciated that gas pressure, mass flow, and paintball presence may be detected using any suitable sensor and/or in any other suitable manner.

Advantageously, dynamically adjusting the speed of the air pump 62 may be used to control the mass flow through one or more portions of the conduit and/or to control the pressure at one or more portions of the conduit. Accordingly, the gas supply 44 as shown in FIG. 11 may advantageously be configured to provide a gas flow that is mass-flow-limited and/or pressure-regulated.

As shown in FIGS. 8-11, a gas supply (such as, the gas supplies 38, 44) may include a variety of components arranged in a variety of configurations. If desired, some or all of these components may be combined in a single component. It will be appreciated, however, that a gas supply does not require the configurations or components shown in FIGS. 8-11 and that a gas supply may include other components in other configurations. If desired, one or more inline pressure regulators may be positioned between a gas container (such as, the gas containers 46, 56) and a valve (such as, the valve 48), which may allow less expensive components of the gas supply to be used. It will also be appreciated that the gas that may be supplied by a gas supply (such as, the gas supplies 38, 44) may comprise carbon dioxide, nitrogen, air, any other suitable gas, or any suitable combination thereof.

In one embodiment, the velocity of one or more paintballs 16 in the delivery system 14 may be measured using, for example, one or more sensors. In response to the measured velocity, the mass flow rate may be dynamically altered using, for example, the mass flow rate control 50 or the air pump 62. Consequently, by altering the mass flow rate, the velocity of the paintballs 16 may be controlled.

Figure 12:
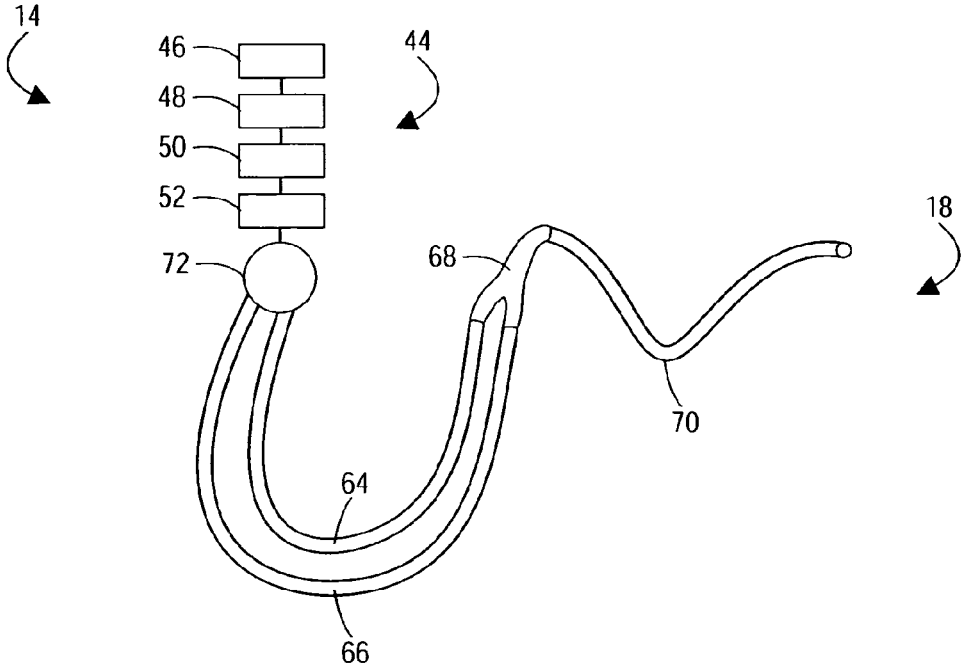
FIG. 12 is a diagram of an exemplary embodiment of the delivery system shown in FIG. 1, illustrating a gas supply, a plurality of tubes and a manifold.

As shown in FIG. 12, the conduit 18 may include a plurality of storage tubes 64, 66; a manifold 68 coupled to the storage tubes 64, 66; and a tube 70 coupled to the manifold 68. The storage tubes 64, 66 may be filled with paintballs 16 to allow the storage tubes to provide storage for the paintballs. The gas supply 44 may be configured to provide gas flow to the storage tubes 64, 66 to move the paintballs 16 from the storage tubes to the manifold 68, from the manifold to the tube 70, and from the tube 70 to a desired location. For example, the tube 70 may be coupled to the hopper 22 to allow the paintballs 16 from the storage tubes 64, 66 to refill the hopper. Also, for example, the tube 70 may be coupled to the feed tube 42 to allow the paintballs 16 from the storage tubes 64, 66 to refill the breech 30 of the marker 12. Thus, the manifold 68 advantageously allows paintballs from a plurality of storage tubes to be moved to a desired location.

In greater detail, the gas supply 44 may include a valve 72, which may receive gas flow from the gas container 46 via the valve 48, the mass flow rate control 50 and the inline pressure regulator 52. The valve 72 may be configured to selectively provide the gas flow it receives. In particular, a person may use the valve 72 to select whether the valve provides gas flow to the storage tube 64 or to the storage tube 66. Accordingly, a person may use the valve 72 to provide the gas flow to the storage tube 64 to move the paintballs in the storage tube 64 to a desired location and, afterwards, to provide the gas flow to the storage tube 66 to move the paintballs in the storage tube 66 to the desired location. For example, while playing a game, a player may empty the paintball hopper 22; refill it from one of the storage tubes 64, 66; empty the paintball hopper 22 again; and refill it from the other of the storage tubes 64, 66. The valve 72 may be configured to be controlled using a remote control device (such as a switch, keypad, or other suitable control device) via wired or wireless connection. The valve 72 may also be configured to be controlled automatically, if desired. Further, the valve 72 may be configured to be physically operated and controlled.

In one embodiment, a storage tube (such as, the storage tube 64 or the storage tube 66) may be configured to hold substantially the same amount of paintballs as a hopper (such as, the hopper 22). Accordingly, when that hopper is emptied, all of the paintballs from the storage tube may be sent to the hopper as a single batch to refill the hopper without overfilling and/or clogging the hopper. It will be appreciated, however, that a storage tube may include any number of paintballs, including more or less than the number of paintballs a hopper may hold. It will also be appreciated that less than all of the paintballs from a storage tube may be sent in multiple batches, if desired.

The delivery system 14 as shown in FIG. 12 is preferably portable and may be attached to a person carrying the delivery system in any suitable fashion. For example, the manifold 68 may be attached to persons' clothing at about the shoulder level or as desired. Also, for example, persons may wear the storage tubes 64, 66 around their midriffs, looped over their shoulders like an ammunition belt of old, or coiled up and attached to the persons' clothing. Further, the storage tubes 64, 66 may be carried in a backpack or in a pocket in a person's clothing, such as in a vest. It will be appreciated that the delivery system 14 may include two or more storage tubes, that the valve 72 may be configured to selectively provide the gas flow to the two or more storage tubes, and that the manifold 68 may be configured to be coupled to and receive paintballs from the two or more storage tubes.

Figure 13:
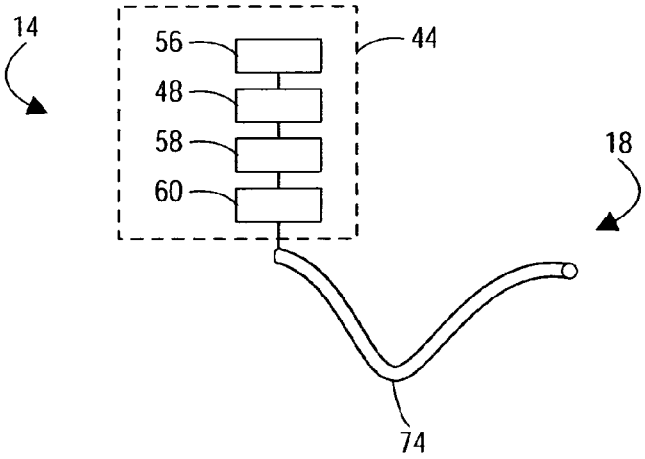
FIG. 13 is a diagram of an exemplary embodiment of the delivery system shown in FIG. 1, illustrating a gas supply and a tube.

As shown in FIG. 13, the conduit 18 may include one or more storage tubes 74. In particular, the conduit 18 may include a single storage tube 74; however, the conduit 18 may include two or more storage tubes connected, for example, in an end-to-end fashion. The gas supply 44 may include the regulated gas container 56, the valve 48, the flow restrictor 58 and the pressure-release pressure regulator 60.

The storage tube 74 may be filled with paintballs 16 to allow the storage tube to provide storage for the paintballs. The gas supply 44 may be configured to provide gas flow to the storage tube 74 to move the paintballs 16 from the storage tube to a desired location. For example, the storage tube 74 may be coupled to the hopper 22 to allow the paintballs 16 from the storage tube to refill the hopper. Also, for example, the storage tube 74 may be coupled to the feed tube 42 to allow the paintballs 16 from the storage tube to refill the breech 30 of the marker 12.

The gas supply 44 may be configured to provide gas flow to the storage tube 74 for a limited amount of time to help prevent overfilling and/or clogging the hopper 22. In further detail, the storage tube 74 is preferably configured to hold more paintballs 16 than the hopper 22 may hold, which may allow the paintballs 16 in the storage tube to repeatedly refill the hopper 22. Unfortunately, if an excessive amount of gas flow were provided to the storage tube 74, an excessive amount of paintballs could be sent to the hopper 22, which could overfill and/or clog the hopper. However, the gas supply 44 may advantageously be configured to provide discrete, limited amounts of gas flow to the storage tube 74 to help prevent or reduce the risk of overfilling and/or clogging the hopper 22. For example, the gas supply 44 may provide a first amount of gas flow to the storage tube 74, which may send a first batch of paintballs 16 from the storage tube 74 to the hopper 22. As needed, the gas supply 44 may provide additional amounts of gas flow to the storage tube 74, which may send additional batches of paintballs 16 from the storage tube 74 to the hopper 22. If desired, the gas supply 44 may be configured to provide a relatively short burst of gas flow to the storage tube 74 to help prevent or reduce the risk of overfilling and/or clogging a relatively small hopper. Accordingly, the gas supply 44 may be used to repeatedly provide short bursts of gas flow to the storage tube 74 to repeatedly refill a relatively small hopper. It will be appreciated that players may find these smaller hoppers desirable because they create a smaller target, are less obstructive to the player's view, and weigh less.

In one embodiment, the valve 48 as shown in FIG. 13 may be configured to, in response to being activated, provide a discrete, limited amount of gas flow, and the valve may be activated using a remote control device via wired or wireless connection, automatically activated, or activated in any other suitable fashion. In one embodiment, a paintball level detecting device may be used to detect the amount of paintballs 16 in a hopper, and based upon an amount of paintballs in the hopper, a control device may automatically control a valve (such as the valve 72 in FIG. 12 or the valve 48 in FIG. 13) to provide gas flow into one or more storage tubes (such as, the storage tubes 64, 66, 74) and thus provide paintballs to the hopper. It will be appreciated that the paintball level detecting device may be used to fill hoppers with any desired paintball capacity.

Figure 14:
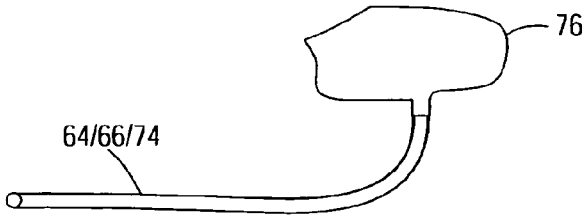
FIG. 14 is a diagram of an exemplary method of filling the tubes shown in FIGS. 12 and 13 with paintballs.

As shown in FIG. 14, a hopper 76 may be used to load a storage tube (such as, the storage tubes 64, 66, 74) with paintballs 16. The hopper 76 may be coupled to an end of the storage tube, allowing the hopper to feed paintballs into the storage tube. The storage tube may be positioned to allow the paintballs 16 from the hopper 76 to roll down the storage tube and stack up from the far end of the storage tube. The hopper 76 is preferably mechanized to more quickly fill the storage tube with paintballs 16. It will be appreciated, however, that any suitable hopper, whether mechanized or non-mechanized, may be used to fill the storage tubes 64, 66, 74 with paintballs 16. It will also be appreciated that the storage tubes 64, 66, 74 may be filled with paintballs 16 by hand, by using a hopper, or by any other suitable means.

Figure 15:
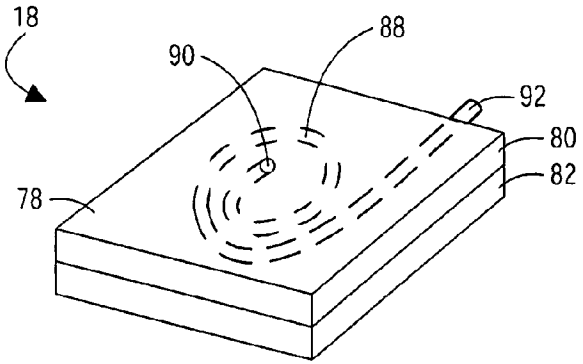
FIG. 15 is a perspective view of an exemplary container.
Figure 16:
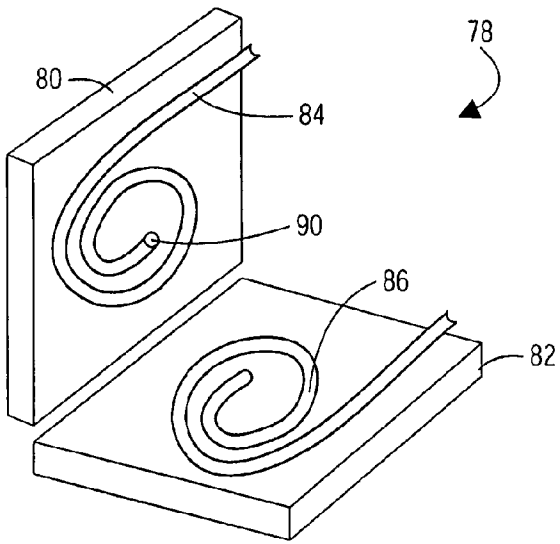
FIG. 16 is another perspective view of the container shown in FIG. 15.

As shown in FIGS. 15-16, the conduit 18 may include a container 78. The container 78 preferably includes a pair of plates or layers 80, 82. The plates 80, 82 may respectively include grooves 84, 86, which preferably have a generally half-circular cross section. When the plates 80, 82 are aligned, the grooves 84, 86 advantageously form a storage passageway 88, which may have a generally circular cross section and may be sized and configured to contain and/or transmit paintballs 16. The storage passageway 88 preferably has a generally coiled shape extending from the passageway's inlet 90 to the passageway's outlet 92. The plates 80, 82 may be interconnected using one or more fasteners; one or more connectors; a snap fit, friction fit and/or an interference fit; and/or any other suitable means.

Advantageously, a gas supply (such as the gas supply 44) may be configured to provide gas flow to the inlet 90 to move the paintballs 16 from the container 78 to a desired location. For example, the outlet 92 may be coupled to a tube, which may be coupled to the hopper 22 to allow the paintballs 16 from the container 78 to refill the hopper. Also, for example, the outlet 92 may be coupled to a tube, which may be coupled to the feed tube 42 to allow the paintballs 16 from the container 78 to refill the breech 30 of the marker 12. The container 78 is preferably portable and may be attached to a person in any suitable fashion. For example, the container 78 may be carried in a backpack or may be attached to a person's clothing on a person's front or back. It will be appreciated that the plates 80, 82; the grooves 84, 86; and the storage passageway 88 may have a variety of other suitable sizes, shapes and configurations, if desired.

The container 78 is advantageously configured to be quickly and easily filled with paintballs 16. In particular, the plates 80, 82 may be separated, and the plate 82 may be placed on a generally level support surface. To fill the container 78 with paintballs 16, paintballs may be poured onto the plate 82 where the paintballs tend to quickly and easily fall into the groove 86. The remaining paintballs 16 that did not fall into the groove may be removed, and the plate 80 may be connected to the plate 82 to form the container 78 filled with paintballs.

In one embodiment, the storage passageway 88 may be configured to hold substantially the same amount of paintballs as a hopper. Accordingly, when that hopper is emptied, all of the paintballs from the container 78 may be sent to the hopper as a single batch to refill the hopper without overfilling and/or clogging the hopper. It will be appreciated, however, that the storage passageway may include any number of paintballs, including more or less than the number of paintballs a hopper may hold. It will also be appreciated that less than all of the paintballs from the storage passageway may be sent in multiple batches, if desired.

Because the container 78 may be considered an appropriate target for competitive paintball play, the container preferably has a limited width that is not excessively larger than the width of a player's body. Of course, the limited width of the container 78 necessarily limits the size of the passageway 88. Consequently, with 68-caliber paintballs, an average player might be able to conceal a container 78 with a single-coiled passageway 88 having a capacity range of about 200 to 300 paintballs, which is sufficient to fill an average sized hopper one or two times. It will be appreciated, however, that players may desire a container that holds more paintballs. But with 68-caliber paintballs, about 5.67 feet of passageway may be required to hold about 100 paintballs. Consequently, a 34-foot passageway may hold about six hundred 68-caliber paintballs, and a 57-foot passageway may hold about one thousand 68-caliber paintballs. Unfortunately, when the length of the passageway 88 is increased to allow the container 78 to hold more paintballs 16, the size of the container 78 may need to be increased, making the container a larger target for an opponent to hit. Thus, while the container 78 and the passageway 88 may advantageously have any desired size, competitive paintball players may opt to have a smaller capacity container 78 that presents a smaller target.

Figure 17:
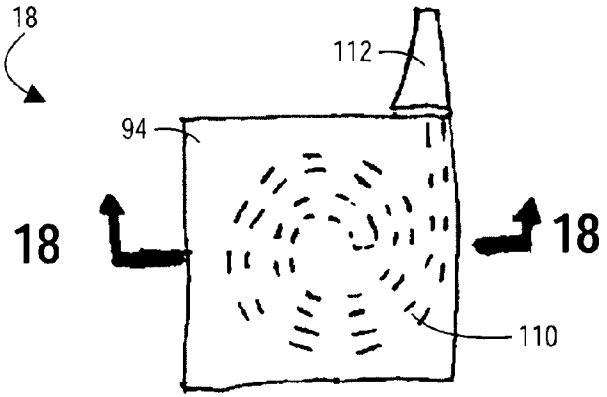
FIG. 17 is top view of another exemplary container.
Figure 18:
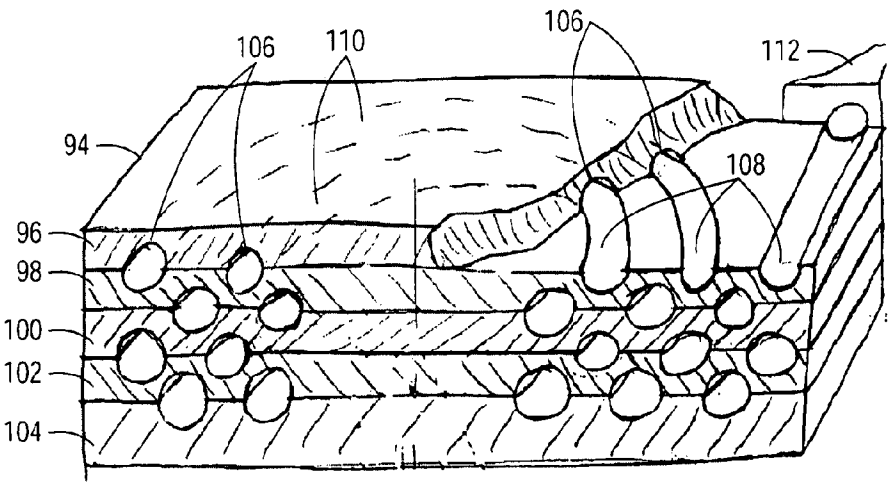
FIG. 18 is a cross sectional view of a portion of the container shown in FIG. 17.

As shown in FIGS. 17-18, the conduit 18 may include a container 94, which advantageously may hold a larger amount of paintballs while presenting a smaller potential target. The container 78 may include a plurality of plates or layers 96, 98, 100, 102, 104. The plates 96, 98, 100, 102, 104 may respectively include grooves (such as, grooves 106, 108), which preferably have a generally half-circular cross section. When the plates 96, 98, 100, 102, 104 are aligned, the grooves advantageously form a plurality of storage passageways (such as a storage passageway 110) that may be sized and configured to contain and/or transmit paintballs 16. Preferably, each storage passageway has a generally circular cross section and has a generally coiled shape, as shown in FIG. 17. Of course, storage passageways may have other cross sections and shapes.

A gas supply may be configured to provide gas flow to an inlet of a storage passageway to move the paintballs 16 from the storage passageway to a manifold 112 and from the manifold to a desired location. For example, the manifold 112 may be coupled to a tube, which may be coupled to the hopper 22 to allow the paintballs 16 from the passageway to refill the hopper. Also, for example, the manifold 112 may be coupled to a tube, which may be coupled to the feed tube 42 to allow the paintballs 16 from the passageway to refill the breech 30 of the marker 12. Thus, the manifold 112 advantageously allows paintballs from a plurality of storage passageways of the container 94 to be moved to a desired location.

In greater detail, the gas supply may include a valve (such as the valve 72 in FIG. 12), which may receive gas flow. The valve may be configured to selectively provide the gas flow it receives. In particular, a person may use the valve to select whether the valve provides gas flow to a particular storage passageway of the container 94. Accordingly, a person may use the valve to provide the gas flow to a first storage passageway to move the paintballs in the first storage passageway to a desired location and, afterwards, to provide the gas flow to a second storage passageway to move the paintballs in the second storage passageway to the desired location. For example, while playing a game, a player may empty the paintball hopper 22; refill it from one of the storage passageways; empty the paintball hopper 22 again; refill it from one of the other storage passageways; empty the paintball hopper 22 again; and refill it from yet another storage passageway. The valve may be configured to be controlled using a remote control device (such as a switch, keypad, or other suitable control device) via wired or wireless connection. The valve may also be configured to be controlled automatically, if desired. Further, the valve may be configured to be physically operated and controlled.

In one embodiment, a storage passageway of the container 94 (such as, the storage passageway 110) may be configured to hold substantially the same amount of paintballs as a hopper. Accordingly, when that hopper is emptied, all of the paintballs from the storage passageway may be sent to the hopper as a single batch to refill the hopper without overfilling and/or clogging the hopper. It will be appreciated, however, that a storage passageway may include any number of paintballs, including more or less than the number of paintballs a hopper may hold. It will also be appreciated that less than all of the paintballs from the storage passageway may be sent in multiple batches, if desired.

As shown in FIG. 18, a plate of the container 94 may include a groove on its upper surface, a groove on its lower surface, or both to form storage passageways. For example, the groove 106 on the lower surface of the plate 96 and the groove 108 on the upper surface of the plate 98 may form a first storage passageway 110; a groove on the lower surface of the plate 98 and a groove on the upper surface of the plate 100 may form a second storage passageway; a groove on the lower surface of the plate 100 and a groove on the upper surface of the plate 102 may form a third storage passageway; and a groove on the lower surface of the plate 102 and a groove on the upper surface of the plate 104 may form a fourth storage passageway. Thus, the container 94 preferably includes five plates, which form four storage passageways. It will be appreciated, however, that the container 94 may include more plates to form more storage passageways or fewer plates to form fewer storage passageways. It will also be appreciated that the plates 96, 98, 100, 102, 104; the grooves of those plates; and the passageways formed by those grooves may have a variety of other suitable sizes, shapes and configurations, if desired. In one embodiment, some or all of the plates 96, 98, 100, 102, 104 may be sized and configured to be substantially interchangeable to allow the capacity of the container 94 to be easily increased or decreased.

As shown in FIG. 18, adjacent storage passageways (and the grooves used to form them) may be generally offset from each other. This generally offset arrangement advantageously may allow an individual plate to compactly form part of two storage passageways. Consequently, the container 94 may be relatively thin and lightweight, while holding a larger amount of paintballs and presenting a smaller potential target. The container 94 is preferably portable and may be attached to a person in any suitable fashion. For example, the container 94 may be carried in a backpack or may be attached to a person's clothing on a person's front or back.

The container 94 is advantageously configured to be quickly and easily filled with paintballs 16. In particular, the plates 96, 98, 100, 102, 104 may be separated, and the plate 104 may be placed on a generally level support surface. The container 94 may be filled with paintballs 16 by pouring paintballs onto the upper surface of the plate 104, allowing the paintballs to enter the groove on the upper surface of the plate 104, removing the excess paintballs from the plate 104, positioning and aligning the plate 102 over the plate 104, pouring paintballs onto the upper surface of the plate 102, allowing the paintballs to enter the groove on the upper surface of the plate 102, removing the excess paintballs from the plate 102, positioning and aligning the plate 100 over the plate 102, pouring paintballs onto the upper surface of the plate 100, allowing the paintballs to enter the groove on the upper surface of the plate 100, removing the excess paintballs from the plate 100, positioning and aligning the plate 98 over the plate 100, pouring paintballs onto the upper surface of the plate 98, allowing the paintballs to enter the groove on the upper surface of the plate 98, removing the excess paintballs from the plate 98, and positioning and aligning the plate 96 over the plate 98. The plates 96, 98, 100, 102, 104 may be interconnected using one or more fasteners; one or more connectors; a snap fit, friction fit and/or an interference fit; and/or any other suitable means.

Figure 19:
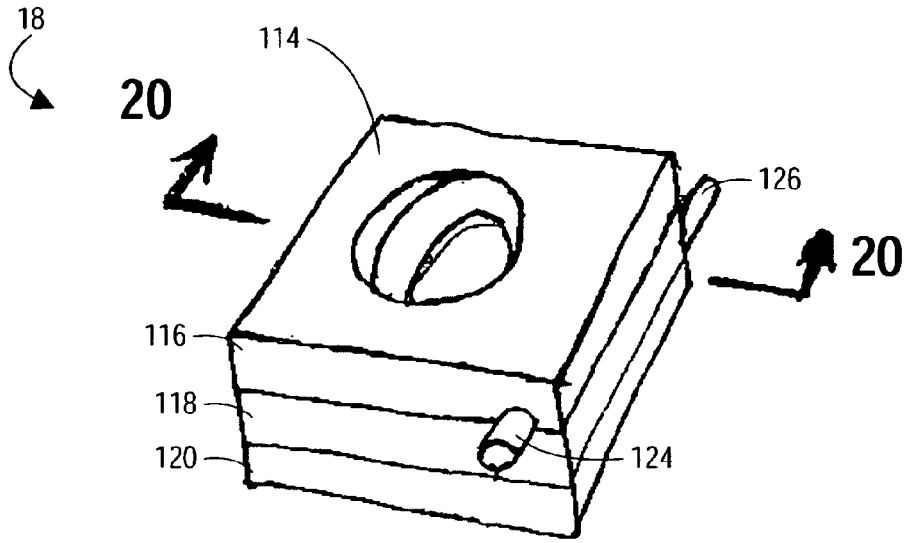
FIG. 19 is a perspective view of yet another exemplary container.
Figure 20:
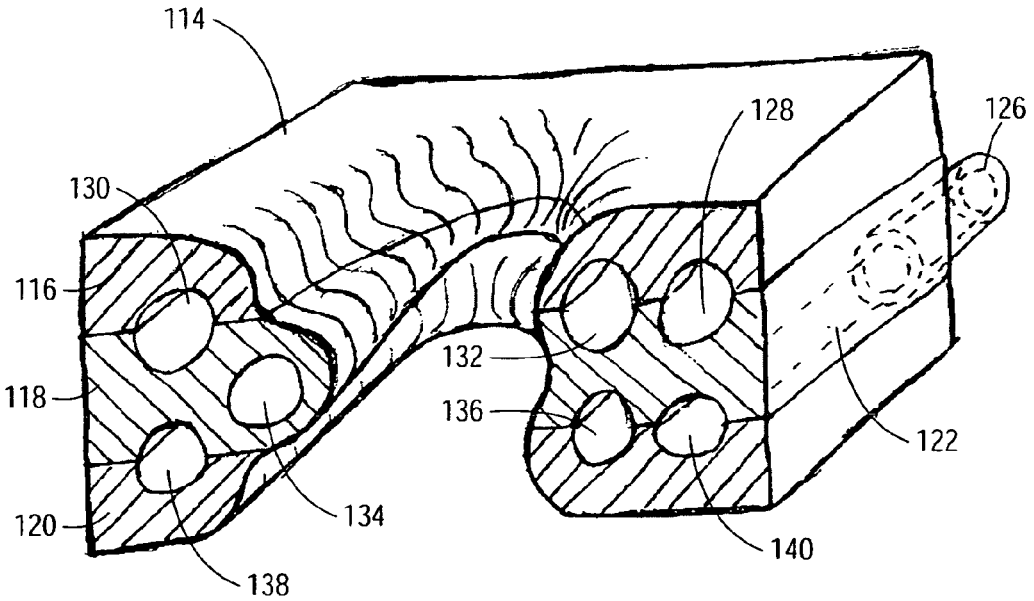
FIG. 20 is a cross sectional view of the container shown in FIG. 19.

As shown in FIGS. 19-20, the conduit 18 may include a container 114. The container 114 may include a plurality of plates or layers 116, 118, 120. The plates 116, 118, 120 may include one or more grooves and/or one or more passageways. The grooves of the plates 116, 118, 120 preferably have a generally half-circular cross section, and the passageways of the plates preferably have generally circular cross sections. When the plates 116, 118, 120 are aligned, the grooves and the passageways of the plates advantageously form a single storage passageway 122, which may have a generally circular cross section and may be sized and configured to contain and/or transmit paintballs 16. The storage passageway 122 preferably has a generally coiled shape extending from the passageway's inlet 124 to the passageway's outlet 126. The plates 116, 118, 120 may be interconnected using one or more fasteners; one or more connectors; a snap fit, friction fit and/or an interference fit; and/or any other suitable means. It will be appreciated that the plates 116, 118, 120; the grooves of the plates; the passageways of the plates; and the storage passageway 122 may have a variety of other suitable sizes, shapes and configurations, if desired. It will also be appreciated that the container 114 may include more plates to form a longer storage passageway—thus allowing the capacity of the container 114 to be adjusted. For example, in one embodiment, a three plate container 114 may hold about four hundred paintballs and a six plate container 114 may hold about one thousand paintballs. Of course, the capacity of the container 114 may depend, for example, upon the particular configuration of the plates and/or the storage passageway formed by the plates.

Advantageously, a gas supply (such as the gas supply 44) may be configured to provide gas flow to the inlet 124 to move the paintballs 16 from the container 114 to a desired location. For example, the outlet 126 may be coupled to a tube, which may be coupled to the hopper 22 to allow the paintballs 16 from the container 114 to refill the hopper. Also, for example, the outlet 126 may be coupled to a tube, which may be coupled to the feed tube 42 to allow the paintballs 16 from the container 114 to refill the breech 30 of the marker 12. In further detail, the gas supply may provide gas flow to the inlet 124 in the plate 116, which gas flow passes past the portion 128, around to portion 130, around to portion 132, around and down to portion 134, around and down to portion 136, around to portion 138, and around to portion 140, and out the outlet 126. Consequently, the paintballs 16 in the storage passageway 122 would follow this path of the gas flow. The container 114 is preferably portable and may be attached to a person in any suitable fashion. For example, the container 114 may be carried in a backpack or may be attached to a person's clothing on a person's front or back.

As shown in FIGS. 21-25, the paintball system 10 may include the conduit 18, which may include a container 142. The conduit 18 may also include a tube 144 coupled to the container 142, a housing 146 coupled to the tube 144, a tube 148 coupled to the housing 146, and a fitting 150 coupled to the tube 148.

Figure 22:
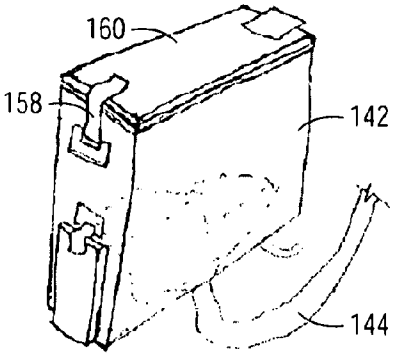
FIG. 22 is a perspective view of a portion of the paintball system shown in FIG. 21.
Figure 23:
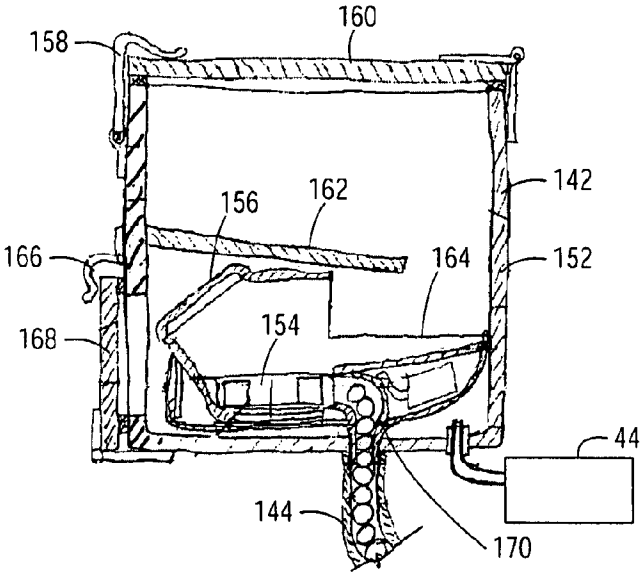
FIG. 23 is a cross sectional view of a portion of the paintball system shown in FIG. 21.

As shown in FIGS. 22-23, the container 142 preferably includes a body 152. The body 152 may advantageously allow storage of paintballs 16 in a jumble, which may allow the paintballs to be stored more efficiently. Because the body 152 may store paintballs 16 more efficiently, the body 152 may be smaller and thus may present a smaller potential target for opponents.

As shown in FIG. 23, the container 142 preferably includes a mechanical pump 154. The pump 154 is preferably configured to pump paintballs 16 from the body 152 of the container 142 into the tube 144. The pump 154 may include an impeller, a conveyor (such as, one or more belts), an agitator, and/or other suitable components. In one embodiment, the container 142 may include a hopper 156 that includes the pump 154. One exemplary hopper that includes a mechanical pump is the HALO™ Loader, which is commercially available from National Paintball Supply, Sewell, N.J., USA. It will be appreciated, however, that the container does not require the hopper 156 and that the pump 154 may be any suitable type of pump.

To fill the container 142 with paintballs 16, a clasp 158 may be unlatched allowing a lid 160 to be opened. With the lid 160 opened, paintballs 16 may be quickly and easily poured into the body 152 of the container 142. As the paintballs 16 flow into the body 152, a guiding member 162 (such as a baffle) may guide the paintballs into the hopper 156 and toward the pump 154. The hopper 156 may be modified to include a cut-out opening 164, which may allow the paintballs 16 to flow into the hopper and toward the pump 154.

After putting paintballs 16 into the body 152, a clasp 166 may be unlatched allowing a door 168 to be opened to access the controls of the hopper 156 to activate the pump 154. If desired, however, the pump 154 may be configured to be controlled using a remote control device (such as a switch, keypad, or other suitable control device) via wired or wireless connection. In addition, the remote control device may be external to the container 142. Thus, the clasp 166 and the door 168 are not required. It will be appreciated that the pump 154 may also be configured to be controlled automatically, if desired.

In response to being activated, the pump 154 may begin sorting and feeding paintballs 16 into the tube 144, which preferably arranges the paintballs in a single-file line. The pump 154 preferably pumps paintballs 16 until such time as the resistance to motion of the single-file line of paintballs into the tube 144 exceeds a preset force output limit for the pump 154. The pump 154 may include a paintball sensor 170. If the paintball sensor 170 indicates the presence of paintballs 16 in the exit port of the hopper 156, the pump 154 may temporarily stop pumping. The container 142 may then be sealed by closing the lid 160, latching the clasp 158, closing the door 168 and latching the clasp 166.

Figure 21:
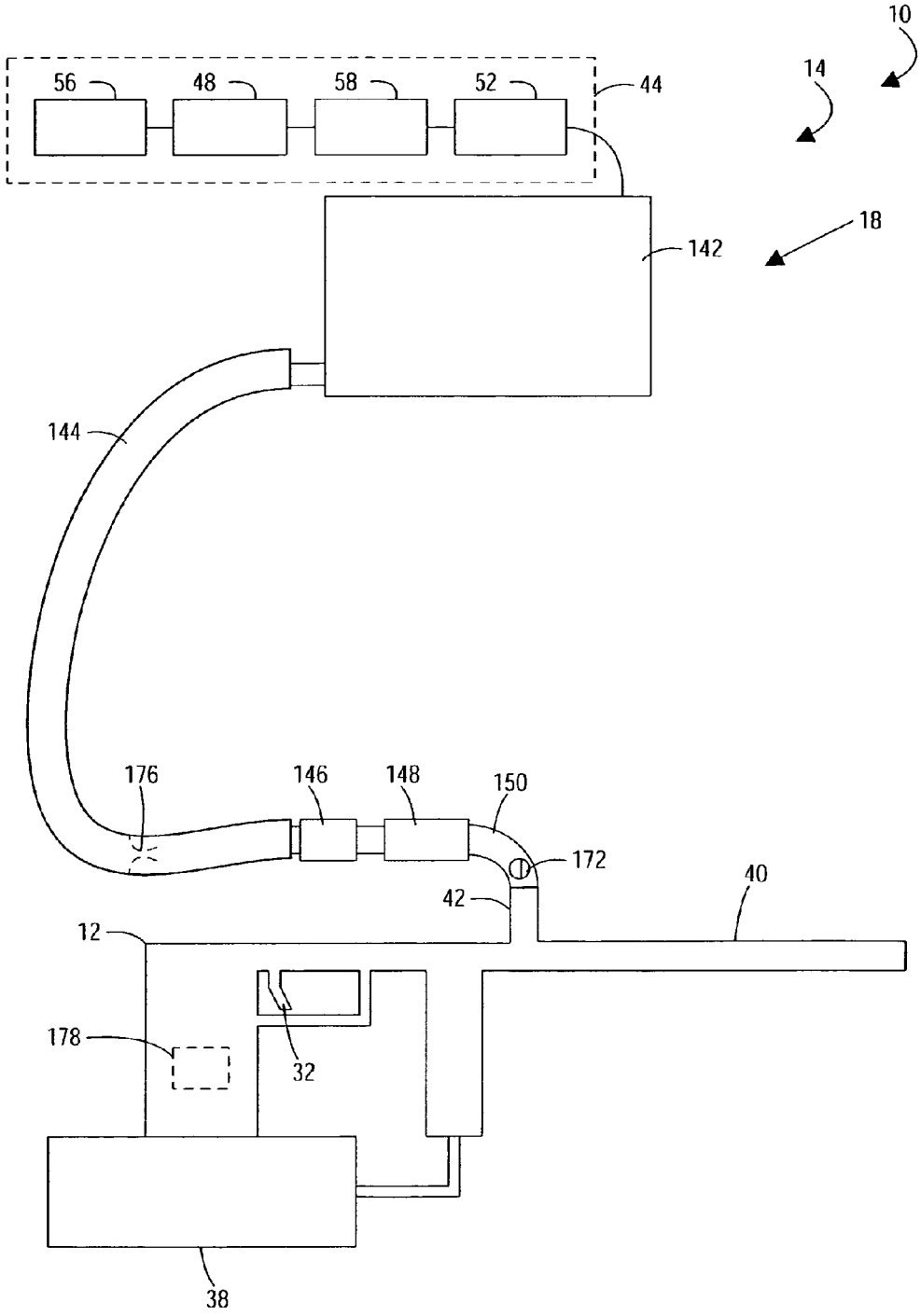
FIG. 21 is a diagram of an exemplary embodiment of the paintball system shown in FIG. 1.

Next, the valve 48 of the gas supply 44 may be activated to provide gas flow to the body 152 of the container 142, from the body 152 of the container 142 to the tube 144, and from the tube 144 to a desired location. For example, as discussed in further detail below with reference to FIG. 21, the tube 144 may be coupled to the housing 146 to allow the paintballs 16 from the tube 144 to move through the housing 146, through the tube 148, through the fitting 150 and through the fill tube 42 to refill the breech 30 of the marker 12. Also, in another example, the tube 144 may be coupled to the hopper 22 (FIG. 2) to allow the paintballs 16 from the tube 144 to refill the hopper. As shown in FIG. 21, the gas supply 44 preferably includes the regulated gas container 56, the valve 48, the flow restrictor 58, and the inline pressure regulator 52. The flow restrictor 58 may be configured to control the mass flow rate of the pressurized gas to the conduit 18, which may help prevent or reduce unintentional breakage of the paintballs during, for example, high gas-flow pumping conditions such as when first filling the tube 144 or finally ejecting the last remaining paintballs 16 from the pump 154 and the container 142. The inline pressure regulator 52 may be configured to limit the pressure in at least a portion of the conduit 18. For example, in cases where a high resistance to mass flow exists (such as, when the paintballs 16 are backed up from the breech 30 of the marker 12 to the exit port of the hopper 156), the inline pressure regulator 52 may limit the pressure in at least a portion of the conduit 18. This may help reduce the overall strength requirements of the conduit 18.

As the gas flow begins to move the paintballs in the tube 144 forward, the paintballs 16 in the exit port of the hopper 156 may begin moving forward into the tube 144. In response to the paintball sensor 170 detecting the absence and/or movement of paintballs 16 in the exit port of the hopper 156, the pump 154 may advantageously restart pumping paintballs into the tube 144 until such time as the resistance to motion of the single-file line of paintballs into the tube 144 again exceeds the pump's preset force output limit.

Prior to activating the pump 154 and the valve 48 of the gas supply 44, a person may elevate the marker 12, which may help facilitate the initial loading of paintballs 16 into the tube 144 and/or other portions of the conduit 18. In particular, a generally continuous line of paintballs 16 extending from the container 142, through the tube 144, and all the way to the breech 30 of the marker may tend to form when the player elevates the marker 12 during the initial loading process.

Once the valve 48 is activated, the valve 48 may be left activated throughout play. In response to activation of the valve 48, pressurized gas flows from the regulated gas container 56, through the valve 48, through the flow constrictor 58, through the inline pressure regulator 52, through the container 142 and into the tube 144. The pressurized gas continues flowing through the tube 144, through the housing 146, through the tube 148, and through the fitting 150 toward the breech 30—moving the paintballs in those components of the conduit 18 toward the breech. The conduit 18 of delivery system 14 may include a vent sized and configured to allow the pressurized gas to escape. For example, the fitting 150 may include a vent 172. If desired, the fill tube 42 or other portion of the marker 12 may include a vent sized and configured to allow the pressured gas to escape. In addition, a portion of the conduit 18 (such as the fitting 150) and a portion of the marker 12 may be sized and configured to form a vent between them when connected, which may also allow the pressured gas to escape.

Figure 24:
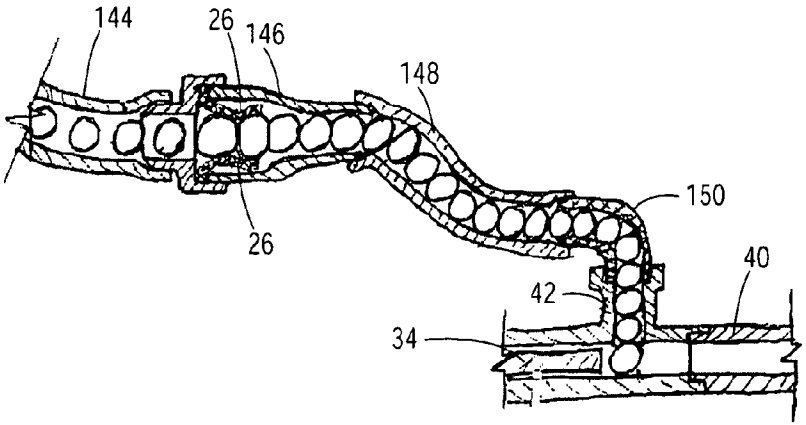
FIG. 24 is a cross sectional view of another portion of the paintball system shown in FIG. 21.

As shown in FIG. 24, the housing 146 may house a seal (such, as the seal 26). The seal 26 is preferably positioned in the gas flow path in the conduit 18. For example, the seal 26 may be positioned between the tubes 144, 148. It will be appreciated that the housing 146 may be connected to the tubes 144, 148 using one or more fasteners; one or more adhesives; one or more connectors; a snap fit, friction fit and/or an interference fit; and/or any other suitable means. It will also be appreciated that the seal 26 may be positioned in any suitable portion of the conduit.

The seal 26 may be sized and configured to allow easy passage of the paintballs 16 from the tube 144 to the tube 148 en route to the breech 30. The seal 26 may also be sized and configured to form a seal with at least one paintball. For example, when the paintball supply exceeds the demand of the marker 12, paintballs may backup from the breech 30 through the fill tube 42, through the fitting 150, through the tube 148, and into the housing 146 to the point where at least one paintball forms a seal with the seal 26. The seal 26 preferably comprises a sleeve. The seal 26 is also preferably constructed from an elastomeric material. It will be appreciated, however, that the seal 26 need not comprise a sleeve and that the seal 26 may comprise a sleeve, a washer, an O-ring, a protrusion (such as a lip) and/or other suitable structures having other suitable sizes, shapes, and/or configurations. It will also be appreciated that the seal 26 may be constructed from other suitable materials having other suitable properties.

When the seal 26 forms a seal with at least one paintball, the pressure in the portion of conduit 18 downstream of the seal 26 (e.g., in the tube 148 and the fitting 150) tends to drop to atmospheric pressure. In addition, when the seal 26 forms a seal with at least one paintball, the pressure tends to increase in the portion of the conduit 18 between the inline pressure regulator 52 and the seal 26. As the pressure increases in the portion of the conduit 18 between the inline pressure regulator 52 and the seal 26, the inline pressure regulator 52 may slow the gas flow into the conduit and may eventually stop the gas flow into the conduit when that pressure reaches a desired maximum pressure limit. Advantageously, limiting the pressure in this fashion may help prevent or reduce unintentional breakage of the paintballs; may help reduce the size, weight and/or cost of the paintball system 10; and may preserve the pressurized gas and thus reduce the overall gas requirements of the paintball system 10.

At that point, when the inline pressure regulator stops the gas flow into the conduit, the flow of paintballs 16 within the conduit 18 may slow to a halt. The axial force required to stop a paintball 16 in the seal 26 and hold it there against the upstream pressure may be related to the axial force available to push paintballs from the feed tube 42 into the breech 30 following the firing of the marker 12. In particular, as the marker 12 resumes firing paintballs, the last paintball that formed a seal with the seal 26 may move forward. This movement forward may open a path to atmosphere for the pressurized gas in a portion of the conduit 18, such as the pressurized gas in the portion of the conduit between the inline pressure regulator 52 and the seal 26. Consequently, the pressurized gas mass flow may resume from the tube 144, through the tube 148, through the fitting 150 and out the fitting's vent 172 to the atmosphere. The resulting pressurized gas mass flow may rapidly convey paintballs in the tube 144 through the seal 26 and may propel paintballs within the tube 148 through the fitting 150 and towards the breech 30 of the marker 12 to allow the marker to continue firing paintballs. In addition, the resulting pressurized gas mass flow may help replenish the paintball supply in the tube 144 with the paintballs in the container 142. This process may continue until, for example, when a particular game is over or when a supply of paintballs is exhausted. Typically, the last three to five paintballs within the paintball system 10 may be provided to the marker 12 via gravity feed.

During use of the delivery system 14 as shown in FIG. 21, gaps may appear between paintballs 16 in the conduit 18 in at least four instances. In a first example, when the seal 26 forms a seal with at least one paintball in the conduit 18 and gas flow into the conduit stops, paintballs may tend to rest in a low spot of the tube 144, which may form a gap between those paintballs and the seal 26. Consequently, when the marker resumes firing and the gas flows through the conduit 18, time elapses before the gas flow pushes those paintballs up to and through the seal 26 and onto the breech 30. If the firing rate of the marker 12 is sufficiently fast, the stack of paintballs formed from the seal 26 to the breech 30 may be depleted before those paintballs from the tube 144 can close the gap—thus starving the marker 12 of paintballs. In a second example, gaps may appear between paintballs 16 in the conduit 18 when the firing rate of the marker 12 exceeds the delivery rate of the pump 154. In particular, it may be possible to outrun the pump 154—thus starving the marker 12 of paintballs. In a third example, a misshaped paintball may have an increased resistance to motion, which may slow the flow of the paintballs and thus create a gap. In a fourth example, if only a few paintballs remain in the tube 144, those remaining paintballs may roll to a low spot when (like in the first example) the seal 26 forms a seal with at least one paintball in the conduit 18 and gas flow into the conduit stops.

Advantageously, the tube 148 may be sized and configured to help prevent or reduce the risk of these gaps that can starve the marker 12 of paintballs. In particular, the length of the tube 148 may be increased, which may increase the length of the stack of paintballs formed from the seal 26 to the breech 30. With more paintballs in the stack available to the marker 12, there is more time for the paintballs in the tube 144 to close the gap by accelerating up to and through the seal 26 and onto the breech 30. This may reduce the risk of starving the marker 12 of paintballs. It will be appreciated that the desired length of the stack of paintballs and the desired length of the tube 148 may depend, for example, upon the particular paintball feed rate to the breech 30 of the marker 12 and/or the marker's firing rate.

As shown above, the delivery system 14 as shown in FIG. 21 may advantageously provide a first mode of breech loading ("pressure mode") and a second mode of breech loading ("flow mode"). These modes are generally characterized by the state of pressurized gas mass flow to the fitting 150.

In pressure mode, when paintballs stack up from the breech 30 to the seal 26 and when the seal 26 forms a seal with at least one of those paintballs, the gas mass flow to the fitting 150 may be at a minimum. In addition, when the seal between the seal 26 and the paintball is formed, the pressure builds in the portion of the conduit 18 upstream from the seal 26, for example, between the inline pressure regulator 52 and the seal 26. This back pressure may generate an axial force, which pushes on the stack of paintballs extending from the seal to the breech 30. The pressure mode's loading rate may be affected by, for example, the amount of the back pressure's axial force on the stack of paintballs. The pressure mode's loading rate may also be affected by the mass of the stack of paintballs, friction, and compliance of the individual paintballs in the stack (each paintball has mass, drag and acts as a spring when compressed). In this pressure mode, after mass-related effects, frictional effects tend to primarily affect the loading rate. As the length of the stack of paintballs increases, the frictional effects tend to grow exponentially. Consequently, if the stack of paintballs is too long, the force available to move the next paintball into the breech 30 may be significantly reduced, thereby limiting its maximum acceleration, extending the drop time and resulting in a reduction in the effective firing rate of the marker 12. However, if the stack of paintballs is too short, the stack of paintballs may be quickly depleted—thus starving the marker 12 of paintballs and reducing the effective firing rate of the marker 12.

In flow mode, as the marker 12 resumes firing paintballs, the last paintball that formed a seal with the seal 26 may move forward. This movement forward may open a path to atmosphere for the pressurized gas in a portion of the conduit 18, such as the pressurized gas in the portion of the conduit between the inline pressure regulator 52 and the seal 26. Consequently, the pressurized gas mass flow may resume from the tube 144, through the tube 148, through the fitting 150, and out the vent 172 of the fitting to the atmosphere. The resulting pressurized gas mass flow may rapidly convey paintballs in the tube 144 through the seal 26 and may propel paintballs within the tube 148 through the fitting 150 and towards the breech 30 of the marker 12. Consequently, the paintballs in the housing 146, the tube 148 and the fitting 150 may push the paintballs in the fill tube 142 towards the breech 30 of the marker.

The flow mode's loading rate may differ from the pressure mode's loading rate. For example, the flow mode's loading rate is typically slower than the pressure mode's loading rate. In these instances, the length of the tube 148 may be increased, which may increase the length of the stack of paintballs extending from the breech 30 to the seal 26. Increasing the length of the stack of paintballs may slow the pressure mode's loading rate to approximately the flow mode's loading rate, which may advantageously allow the delivery system 14 to provide a generally consistent loading rate regardless of the mode of breech loading. This may be particularly useful for markers having firing rates less than or equal to about fifteen balls per second.

Figure 25:
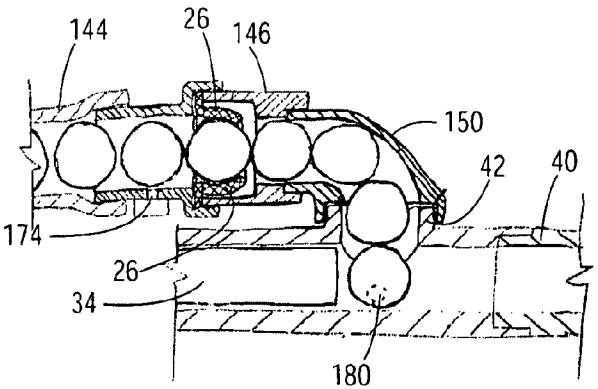
FIG. 25 is a cross sectional view of a portion of an exemplary embodiment of the paintball system shown in FIG. 21.

As shown in FIG. 25, the conduit 18 may be modified. In particular, as shown in FIG. 25, the tube 148 may be removed, allowing the housing 146 to be directly coupled to the fitting 150. Consequently, the length of the stack of paintballs extending from the breech to the seal 26 is reduced to a relatively short length of five paintballs: one paintball in the breech, one paintball forming a seal with the seal 26, and three paintballs in between. As mentioned above, when a seal between the seal 26 and the paintball is formed, the pressure in the portion of conduit 18 downstream of the seal 26 (e.g., in the fitting 150) tends to drop to atmospheric pressure. In addition, when the seal between the seal 26 and the paintball is formed, the pressure builds in the portion of the conduit 18 upstream from the seal 26. This back pressure may generate an axial force, which compresses the relatively short stack of paintballs. When a trigger of the marker 12 is pulled, the bolt 34 of the marker may extend forward, closing the breech and pushing the paintball in the breech into the firing chamber of the marker; the firing chamber may be pressurized with gas that propels the paintball out of a barrel 40 of the marker; and the bolt 34 may retreat. When the bolt 34 retreats, the compressed stack of four remaining paintballs may spring apart while also being pushed toward the now vacant breech. These four paintballs tend to interact with each other to help quell the natural tendency of the paintballs to bounce in the breech of the marker 12—reducing the marker delay for debounce time and thus allowing potentially faster marker firing rates.

As shown in FIG. 25, when the paintball that formed a seal with the seal 26 moves forward and opens a path to the atmosphere, pressurized gas mass flow may resume from the tube 144, through the fitting 150 and out the fitting's vent 172 to the atmosphere. The resulting pressurized gas mass flow tends to quickly convey paintballs in the container 142, the tube 144 and the fitting 150 one paintball diameter. Consequently, the tube 144 and the fitting 150 advantageously tend to remained packed with paintballs.

As mentioned above, during use of the delivery system 14, gaps may appear between paintballs 16 in the conduit 18. Some high performance markers may be capable of firing fifteen balls per second, thirty balls per second or more. Consequently, the reduction or removal of these gaps may be more important given that such markers may quickly deplete the stack of paintballs extending from the breech to the seal 26. In one embodiment, the high performance marker may include trigger circuitry that may use a paintball sensor 174 to detect the absence of a paintball and, in response, adjust marker firing rate.

To help reduce or remove these gaps, the conduit 18 may include at least one seal 176 (FIG. 21) that is preferably disposed upstream from the seal 26. The seal 176 preferably allows paintballs to quickly and easily pass through. The seal 176 is also preferably sized and configured to form a seal with at least one paintball, for example, when paintballs stack up from the breech to the seal 26 and from the seal 26 to the seal 176. The seal 176 preferably comprises a sleeve. The seal 176 is also preferably constructed from an elastomeric material. It will be appreciated, however, that the seal 176 need not comprise a sleeve and that the seal 176 may comprise a sleeve, a washer, an O-ring, a protrusion (such as a lip) and/or other suitable structures having other suitable sizes, shapes, and/or configurations. It will also be appreciated that the seal 176 may be constructed from other suitable materials having other suitable properties. It will be further appreciated that the conduit 18 may include two or more seals 176, but that the conduit does not require any seals 176.

The seal 176 is preferably configured to withstand less than a pressure limit set by, for example, the inline pressure regulator 52. Thus, the seal 176 contrasts with the seal 26, which preferably can withstand the pressure limit set by the inline pressure regulator 52. For example, the pressure limit of the inline pressure regulator 52 may be set to 4 psig, and the seal 176 may be sized and configured to withstand 0.5 psig before the seal 176 leaks gas. In this example, for a paintball to be constrained to stop in the seal 176, there would need to be approximately 0.18 pound-force applied to that paintball in the opposite direction. That force is approximately the weight of twenty-seven conventional paintballs. Therefore, placing such a seal 176 in the gas flow path of the conduit may be used to generate a local pushing force to help convey paintballs through a troublesome spot (even during low gas mass flow rate conditions) and thus may help reduce or eliminate gaps between the paintballs. It will be appreciated that the pressure limit of the inline pressure regulator 52 may be set to other amounts and that the seal 176 may withstand other amounts of pressure. It will also be appreciated that the conduit 18 may have any number of seals 176 in any suitable location. Exemplary locations for these seals 176 include proximate the middle of the tube 144, between the container 142 and the tube 144, or other suitable locations that may help keep paintballs near the seal 26.

As shown in FIG. 21, the marker 12 may include a programmable trigger control module 178. The programmable trigger control module 178 may provide a "burst" mode in which the marker 12 fires multiple paintballs in response to a single pull of the trigger. Of course, the programmable trigger control module 178 may provide a variety of other suitable modes.

The programmable trigger control module 178 may also help prevent or reduce the risk of the bolt 34 undesirably breaking a paintball. In particular, when a paintball is loaded into the breech of the marker, the paintball may bounce up and down for a period of time (called "debounce" time). Unfortunately, if the marker 12 is fired when the paintball is bouncing, the bolt 34 could break the paintball. This breakage could create a mess requiring substantial cleaning before the paintball system 10 could properly function (or even function at all). During a competitive paintball game, players may not have sufficient time to clean up such a mess. And, even if the players had sufficient time, the players would be more vulnerable targets while cleaning their systems. Consequently, this paintball breakage would leave players with two poor alternatives: playing with an improperly functioning (or non-functioning) paintball system or cleaning their paintball systems with a higher risk of being hit by an opponent. However, the programmable trigger control module 178 may advantageously provide a programmable delay to wait for the debounce time to elapse before the bolt moves forward and the marker is fired.

In determining when (or whether) to start the debounce delay, the programmable trigger control module 178 may advantageously receive information from a sensor 180, which may detect the presence of a paintball, the absence of a paintball, the presence of the bolt 34, and/or the absence of the bolt. The sensor 180 may comprise a pair of diodes that detect whether light is transmitted between the diodes. It will be appreciated, however, that the sensor 180 may comprise any other suitable sensor.

In one example of a burst mode, if the sensor 180 detects the presence of a paintball when a trigger 32 of the marker 12 is pulled, the bolt 34 may extend forward, closing the breech and pushing the paintball into the firing chamber; the firing chamber may be pressurized with gas that propels the paintball out of a barrel 40 of the marker; and the bolt 34 begins retreating. As the end of the bolt 34 clears the sensor 180, programmable trigger control module 178 may start a timer for measuring the drop time. After the bolt 34 fully retreats (which typically takes less than about 1 millisecond from the time the bolt's end passes the sensor 180), the next paintball enters the breech. When this next paintball blocks the sensor 180, the timer for measuring the drop time stops and the debounce timer begins. When the debounce timer expires, the programmable trigger control module 178 activates the bolt 34, a delay may occur while the bolt accelerates from rest and this cycle may repeat. If the debounce timer were set to 0 milliseconds, the programmable trigger control module 178 may activate the bolt when the next paintball blocks the sensor 180, for example, when the paintball is nearly to the bottom of the breech.

With a more consistent drop time, the programmable trigger control module 178 could start timing when the bolt 34 retracted and cleared the sensor 180 instead of waiting for the next paintball 16 to block the sensor. A delay based on the bolt 34 retracting could be programmed to allow for a consistent drop time plus a small variability in time minus the natural delay required for the bolt 34 to accelerate from rest. Thus, an overall increase in marker firing rate may be realized.

A pressure mode of breech loading (described above) may advantageously help provide that more consistent drop time. The pressure control equates to force control so the forcing function responsible for breech loading tends to be very repeatable. In contrast, certain mechanized loaders tend to have substantially varying loading rates based upon, for example, the wind on their springs or their bulk load of paintballs in its impeller. In addition, as shown in FIG. 25, the stack of paintballs may be relatively short thereby reducing the mass that needs to be accelerated in the loading process, reducing the retarding friction forces, and reducing the probability of shape and sized based paintball 16 interactions resulting in unpredictable paintball 16 resistance to motion. Consequently, loading may be faster and more consistent. Further, with these reductions in retarding effects, the gas pressure induced pushing force may be reduced in magnitude thereby being relatively gentle on the fragile paintballs 16.

Thus, increased effective marker firing rates may be obtained by levering pressure mode of breech loading and configuring the programmable trigger control module 178 to, when the end of the bolt 34 clears the sensor, start a delay timer based upon system parameters. In addition, improved system reliability may be realized by further including provisions for quickly changing the programmable trigger control module 178's reference point back to the standard timing configuration (based on the paintball blocking the sensor 180) when the delivery system 14 switches from the pressure mode of loading to the slower, flow mode of breech loading. If desired, the sensor 174 (FIG. 25) may be used to determine whether delivery system 14 is the pressure mode or the flow mode. In particular, when the sensor 174 detected a paintball, pressure mode would be indicated; and flow mode would be indicated when the sensor 174 did not detect a paintball. It will be appreciated that the sensors 174, 180 could be coupled to the programmable trigger control module 178 in any suitable fashion.

Figure 26:
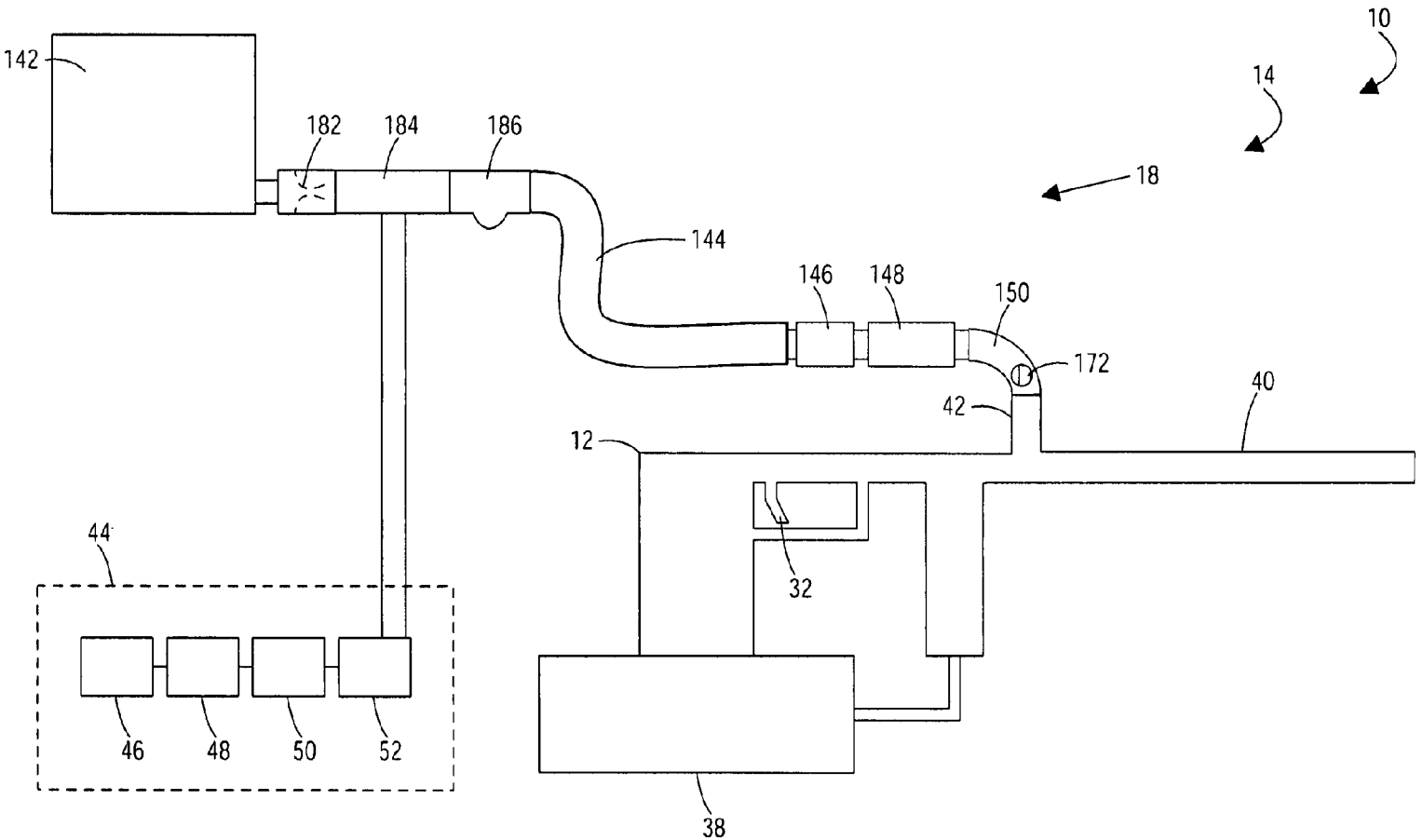
FIG. 26 is a diagram of another exemplary embodiment of the paintball system shown in FIG. 1.

As shown in FIG. 26, the storage container 142 (FIGS. 21-25) need not be pressurized from the gas supply 44. The pump 154 of the container 142 may advantageously be activated to pump paintballs through a seal 182, through the fitting 184, past the sensor 186, and into the tube 144 until the force limit of the pump 154 is reached. The valve 48 may also be activated. Once the valve 48 is activated, the valve 48 may be left activated throughout play. In response to activation of the valve 48, pressurized gas flows from the gas container 46, through the valve 48, through the mass flow rate control 50, through the inline pressure regulator 52, and to the fitting 184. The seal 182 is preferably sized and configured to form a seal with at least one paintball. Accordingly, the pressurized gas continues flowing from the fitting 184, past the sensor 186 and into the tube 144. The pressurized gas flows through the tube 144, through the housing 146, through the tube 148, and through the fitting 150 toward the breech 30—moving the paintballs in those components of the conduit 18 toward the breech.

The sensor 186 is preferably configured to detect the presence and absence of paintballs. In response to the sensor 186 detecting the absence of paintballs, the pump 154 may restart pumping paintballs through the seal 182, through the fitting 184, past the sensor 186, and into the tube 144. Advantageously, this may help provide a generally continuous single-file line of paintballs in the conduit 18. When paintballs backup from the breech of the marker to the seal 26 in the housing 146 and the flow of pressurized gas stops, the pump 154 may continue to pump until its force limit is again reached. At this point, in contrast to startup, the pump 154 is pushing paintballs into a pressurized zone requiring that some of the pump's force be used to overcome the pressure effects on the paintballs in the seal 182.

Figure 27:
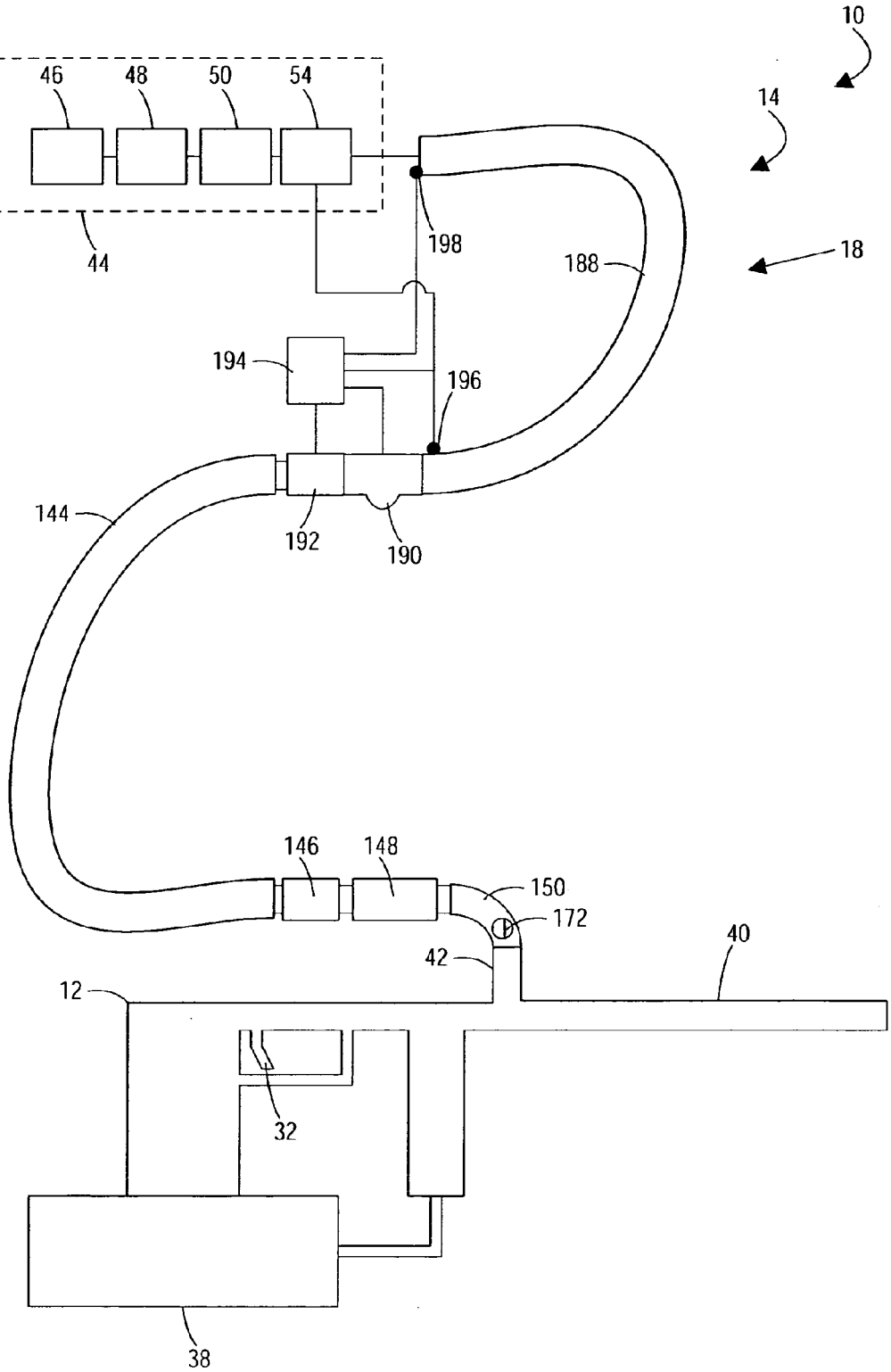
FIG. 27 is a diagram of yet another exemplary embodiment of the paintball system shown in FIG. 1.

As shown in FIG. 27, the conduit 18 may include a container (such as tube 188 or any other suitable container), a sensor 190, and a gas bleed 192; and the delivery system may include a bleed control module 194. The tube 188 is preferably configured to hold about one thousand paintballs; however, the tube 188 may hold fewer or more paintballs.

As shown in FIG. 27, the gas supply 44 may include the pilot pressure regulator 54. The pilot pressure regulator 54 preferably adjusts the gas flow from the pilot pressure regulator's inlet to the pilot pressure regulator's outlet based on the pressure at a reference point 196, which is preferably located proximate an outlet of the tube 188. However, the reference point 196 may be positioned in other suitable locations, including but not limited to upstream from the seal 26. The pilot pressure regulator 54 may receive the pressure information for the reference point 196 electronically (for example, via a signal from a pressure transducer); physically (for example, a pressure piped in from the reference point); or in any other suitable fashion.

To begin use of the paintball system 10 shown in FIG. 27, the tube 188 may be filled with paintballs. The valve 48 of the gas supply 44 may be activated. Initially, the pressure at the reference point 196 indicates approximately atmospheric pressure at the outlet of the tube 188. In response to this pressure, the pilot pressure regulator is configured to allow its maximum gas flow condition. Consequently, pressurized gas flows from the gas container 46, through the valve 48, through the mass flow rate control 50, through the pilot pressure regulator 54, through the tube 188, past the sensor 190, past the gas bleed 192, through the tube 144, through the housing 146, through the tube 148, through the fitting 150 and out the vent 172—moving the paintballs in those components of the conduit 18 toward the breech of the marker 12.

Initially, the gas flow rate through the conduit 18 is at its maximum, as controlled by the mass flow rate control 50. It will be appreciated that the pressure required to attain any given mass flow rate over a line of paintballs within a generally cylindrical structure is proportional to the length of the line. For example, if the line were one hundred paintballs long and 2 psi over the line would result in a target gas mass flow rate, a column of one thousand paintballs might require approximately 20 psi over the line to attain the same gas mass flow rate. Of course, the resistance to gas flow of an empty cylindrical storage chamber or tube is very low when compared to that of a chamber or tube populated with paintballs 16. Thus, almost all of the pressure drop within the system occurs over the populated areas.

The gas gauge pressure applied to the line of paintballs within the tube 188 at the reference point 198 is preferably whatever is required to achieve the maximum gas mass flow rate through the line of paintballs. Advantageously, the maximum gas mass flow rate may be chosen to facilitate paintball conveyance up and down and around any twists and turns of the tube 188 or other cylindrical storage passageways (such as, those of containers 78, 94, 114; or the tube 74).

Initially, the paintballs within the tube 188 start at rest. The pressure applied at the reference point 198 increases to establish the maximum gas mass flow rate to induce paintball movement, which in turn lowers the pressure required to sustain the flow rate. For example, the gas pressure at the reference point 198 may rise to twenty psig initially and the decrease to about ten psig when the line of paintballs reach their maximum velocity (this is an example of the fluid structure interaction part of the complicated compressible, turbulent, internal, time dependent flow typical of embodiments of the invention).

As previously discussed, prior to activating the valve 48 of the gas supply 44, a person may elevate the marker 12, which may help facilitate the initial loading of paintballs 16 into the conduit 18. In particular, a generally continuous line of paintballs 16 extending from the breech 30 of the marker may tend to form when the player elevates the marker 12 during the initial loading process.

The gas gauge pressure at the outlet of the tube 188 (as measured at the reference point 196) preferably starts at zero and it tends to stay approximately zero psig until paintballs exit the tube 188 and begin to populate the downstream portions of the conduit. In particular, as previously discussed, when the paintball supply exceeds the demand of the marker 12, paintballs may backup from the breech 30 through the fill tube 42, through the fitting 150, through the tube 148, and into the housing 146 to the point where at least a portion of at least one paintball forms a seal with the seal 26. When the seal 26 forms a seal with at least one paintball, the pressure tends to increase at the reference point 196.

When the pressure at the reference point 196 reaches the set-point (e.g., the operating pressure selected for the desired breech loading rates), the pilot pressure regulator 54 adjusts the gas flow to the inlet of the tube 188 to the gas flow required to sustain the set-point pressure at the reference point 196. Until marker firing resumes, the gas mass flow and the velocity of the paintballs in the tube 188 are preferably both near zero. Additionally, the gas pressure within the sealed portion of the conduit 18 tends to equalize, that is, it is substantially the same gas pressure everywhere in the sealed portion of the conduit.

When used with the tube 188 (or other container) that has a relatively long, generally cylindrical storage passageway, the pilot pressure regulator 54 may advantageously allow the seal 26 and the tube 144 to operate at lower pressures. For example, an inline pressure regulator 52 may set its maximum pressure to 20 psig to accommodate the 1000 paintballs in the tube 188. The force required to hold a paintball 16 in the seal 26 at 20 psig is about 7 pounds of force. Accordingly, the stack of paintballs extending from the breach to the seal might not be sufficiently strong to both support that amount of force and also resist breakage when loaded into the breech with such force.

However, with a pilot pressure regulator 54, the initial pressure at the inlet of the tube 188 may still go to the exemplary 20 psig; but the pilot pressure regulator 54 may restrict the gas flow to a lower pressure, such as 5 psig, when the seal 26 seals with at least one paintball. Accordingly, with a pilot pressure regulator 54, the stack of paintballs would not have to support as much force and would have less risk of breakage when loaded into the breech. In one embodiment, at about 3 psig, a five-ball stack (as shown in FIG. 25) may load a marker 12 capable of firing in excess of thirty paintballs per second. Consequently, the advantages bestowed by running lower gas pressures may be realizable without significant breech loading degradation. However, the pressure may be increased to supply faster firing markers with paintballs as desired.

As mentioned above, gaps may appear between paintballs 16 in the conduit 18. Unfortunately, in an embodiment in which the tube 188 is about 57 feet long (to accommodate roughly one thousand 68-caliber paintballs), a gap could reach up to 20 feet or more—thus requiring a relatively long time for paintballs to close the gap. Advantageously, the impact to the player may be reduced by controllably inducing a gas mass flow rate within the tube 188 capable of producing paintball conveyance within the tube toward the tube's exit port, thereby closing up the gaps and tending to restock the tube 144 with paintballs 16 even when the system is operating in the low mass flow rate, pressure mode of breech loading.

In further detail, as shown in FIG. 27, the bleed control module 194 may receive information identifying the pressure at the reference point 196, information identifying the pressure at the reference point 198 and information identifying whether the sensor 190 detects a paintball. The bleed control module 194 may advantageously use this information to selectively activate the gas bleed 192 to release pressurized gas. In particular, the bleed control module 194 may activate the gas bleed 192 when the gas pressure at the inlet of the tube 188 is sufficiently greater than the pressure at the outlet of the tube 188 (indicating the tube 188 is not empty and there is likely some marker activity) and the sensor 190 does not detect a paintball. By activating the gas bleed 192, pressurized gas flows from the inlet of the tube 188 to the outlet of the tube 188 and out the gas bleed to the atmosphere. Advantageously, the gas bleed 192 may be designed to allow the desired gas mass flow rate to occur within the tube 188 while maintaining the gas pressure within the tube 144 used for breech loading of the marker in the pressure mode so that rapid marker firing may continue as the gaps in the paintball supply are closed. When the sensor 190 again detects paintballs, the bleed control module 194 may deactivate the gas bleed 192 and normal system operation may resume. It will be appreciated that this bleeding process may be repeated. When the stock of paintballs in the tube 188 is depleted, the bleed process preferably does not occur. The bleed control module 194 may be implemented using hardware components, software components, and/or other suitable components; and the bleed control module 194 may be programmable, if desired.

The sensor 190 is preferably positioned far enough away from the marker 12 to allow a sufficient stock of paintballs to exist and be used by the marker while the bleeding closes the gaps in the paintball flow. For example, if the sensor 190 were placed near the outlet of the tube 188 and the tube 144 were about forty inches long, there might be approximately fifty-eight paintballs 16 within the tube 144 available for player use while the bleeding process occurs.

The sensor 190 and the gas bleed 192 may be reversed in order and/or placed elsewhere in the conduit 18. For example, a person could route the tube 144 up and over the person's shoulder such that the tube formed a U-shape between them and the marker 12 when the person assumed a common shooting stance. In this example, the gas bleed 192 may be placed in the tube 144 at about the apex formed over the person's shoulder and the sensor 190 may be placed a few inches further down in the tube 144 such that it monitors paintball presence on the downhill side of the U-shape. Also, for example, the sensor 190 and/or the gas bleed 192 may be proximate (and/or positioned upstream from) the housing 146 and/or the seal 26. Further, if desired, the paintball system 10 may include multiple sets of sensors 190 and gas bleeds 192 disposed in a variety of locations along the conduit 18.

In one embodiment, a gas bleed system need not be electronic in nature. For example, a gas bleed system may include a paintball sensing component, which may be positioned in generally the same position as the sensor 190. The paintball sensing component may comprise a seal, a sleeve and/or other suitable structures, which may have a pressure difference over it when populated with paintballs 16. That pressure difference may be used along with the pressure difference over the tube 188 to selectively control the gas bleed to atmosphere using, for example, one or more slider valves, diaphragms, and/or other suitable structures. An advantage to this slider valve based system may be its passive nature, that is, it does not need an electrical power supply, for example, a battery.

Figure 28:
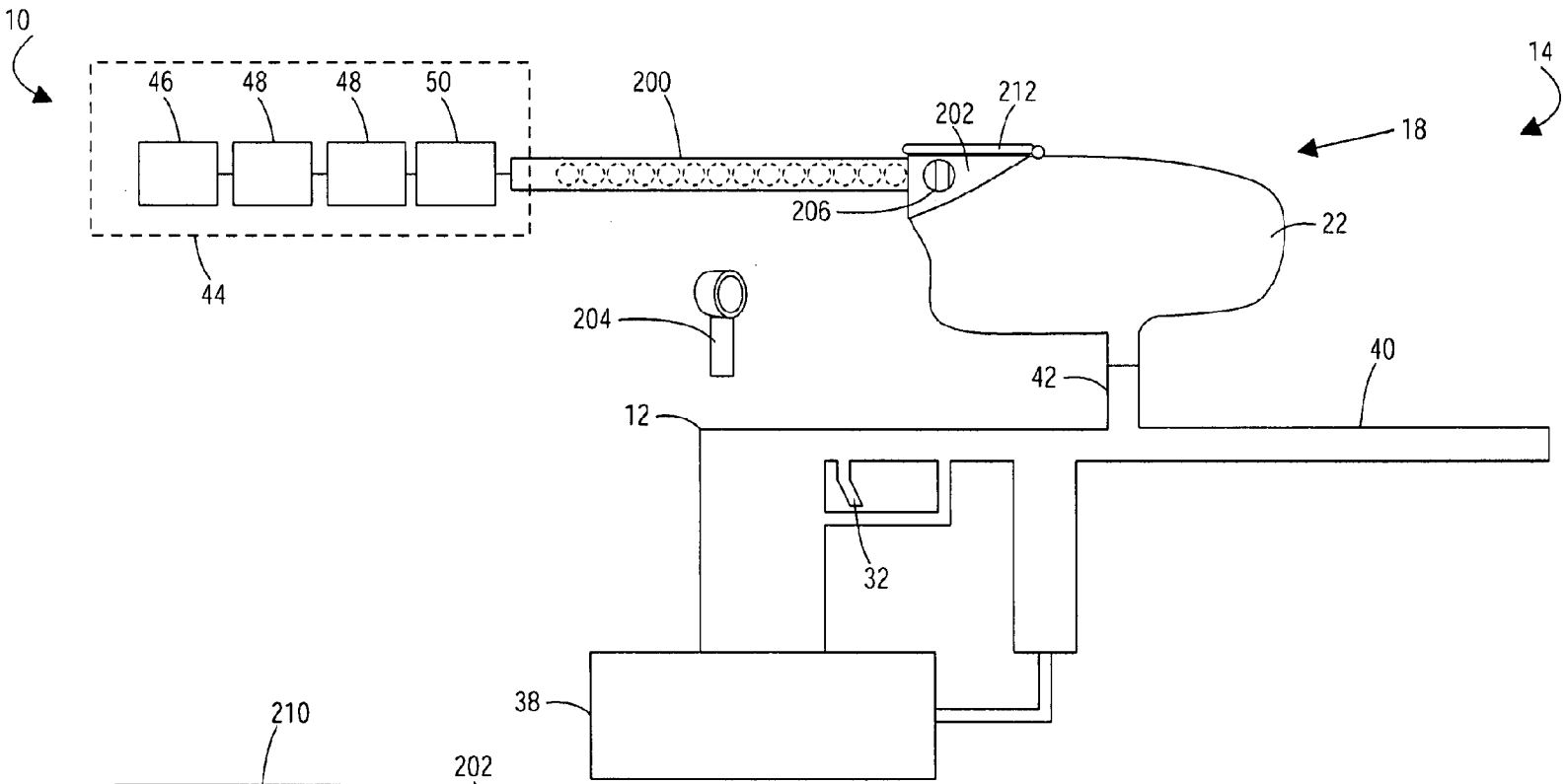
FIG. 28 is a diagram of still another exemplary embodiment of the paintball system shown in FIG. 1.

As shown in FIG. 28, the conduit 18 may include a tube 200, which preferably is filled with a plurality of paintballs. It will be appreciated that the length of the tube 200 will determine its capacity. The tube 200 may be coupled to the gas supply 44 and to an adapter 202. If desired, the adapter 202 may form part of the hopper 22. The paintball system 10 may also include a bracket 204, which may be sized and configured to be connected to the marker 12 and to help support the tube 200.

Advantageously, the paintballs in the tube 200 may be used to refill the hopper 22. In particular, the valve 48 may be activated to advantageously supply gas flow to the conduit 18. The gas flow may pass through the tube 200, through the adapter 202, and out the adapter's vent 206 to the atmosphere. This gas flow may convey paintballs in the tube 200 through the adapter 202 and into the hopper 22.

In one embodiment, the valve 48 may be activated using a remote control device via wired or wireless connection, automatically activated, or activated in any other suitable fashion. In one embodiment, a paintball level detecting device 208 may be used to detect the amount of paintballs 16 in the hopper 22; and based upon an amount of paintballs in the hopper, a control device may automatically control the valve 48 to provide gas flow into the tube 200 and thus provide paintballs to the hopper. As may be appreciated, an automatic refill process may allow a player to continue in the game in a substantially uninterrupted fashion.

Figure 29:
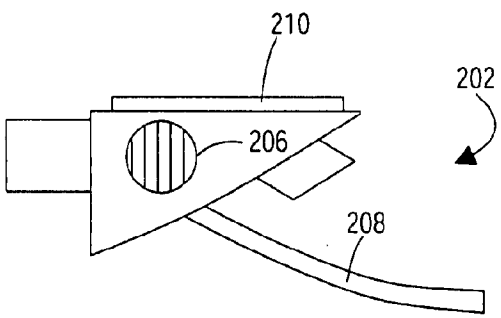
FIG. 29 is a diagram of an exemplary adapter.

As shown in FIGS. 28-29, the adapter 202 may include an attachment portion (such as, an attachment portion 210), which is preferably sized and configured to be connected to a lid 212 or other portion of the hopper 22 using, for example, a snap fit, a friction fit, magnetic attraction, and/or an interference fit.

Figure 30:
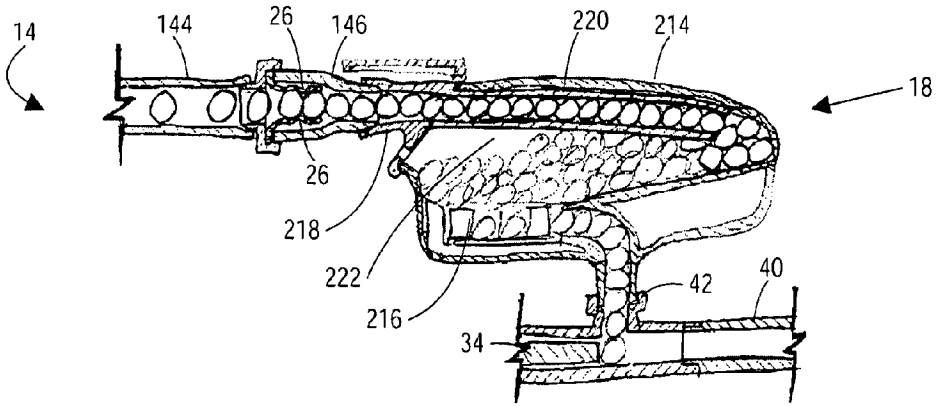
FIG. 30 is a cross sectional view of a portion of an exemplary embodiment of the paintball system shown in FIG. 1.

As shown in FIG. 30, the conduit 18 may include a hopper 214, which may include a pump 216. The gas supply 44 (FIG. 21), the container 142 (FIG. 21), the tube 144 (FIG. 21), and the housing 146 (FIG. 21) may be coupled to the hopper 214 using an adapter 218. If desired, the adapter 218 may form part of the hopper 214. The adapter 218 may include a tube 220 sized and configured to contain and transmit paintballs, preferably in a single-file line. The tube 220 preferably extends into a hollow interior portion 222 of the hopper 214.

The pump 216 and the gas supply 44 may be activated to begin use of the paintball system. As described above, once the gas supply 44 is activated, the gas supply may be left activated throughout play. In response to activation of the gas supply, pressurized gas flows through the container 142, through the tube 144, through the housing 146, and through the adapter 218—moving the paintballs in those components toward the hopper 214. The conduit 18 may include a vent sized and configured to allow the pressurized gas to escape. For example, the adapter 218 may include a vent, for example, like the vent 206 of the adapter 202 shown in FIGS. 28-29. If desired, the fill tube 42 or other portion of the marker 12 may include a vent sized and configured to allow the pressurized gas to escape. In addition, a portion of the conduit 18 (such as the adapter 202) and a portion of the hopper 214 may be sized and configured to form a vent between them when connected, which may also allow the pressured gas to escape.

When the paintball supply exceeds the demand of the hopper 214, paintballs may backup from a jumbled arrangement of paintballs at the end of the tube 220 through the adapter 218 and into the housing 146 to the point where at least a portion of at least one paintball forms a seal with the seal 26. As described above, when the seal 26 forms a seal with at least one paintball, the pressure tends to increase in the portion of the conduit 18 between the inline pressure regulator 52 and the seal 26. As the pressure increases between in the portion of the conduit 18 between the inline pressure regulator 52 and the seal 26, the inline pressure regulator 52 may slow the gas flow into the conduit and may eventually stop the gas flow into the conduit when that pressure reaches a desired maximum pressure limit.

Advantageously, the delivery system 14 as shown in FIG. 30 may help prevent or reduce the risk of overfilling and/or clogging the hopper 214. In particular, as the hopper 214 feeds paintballs to the marker 12 and the hopper has room for additional paintballs, the last paintball that formed a seal with the seal 26 may move forward. This movement forward may open a path to atmosphere for the pressurized gas upstream from the seal 26. Consequently, the pressurized gas mass flow may resume from the tube 144, through the housing 146, and through the adapter 218 and out the adapter's vent to the atmosphere. The resulting pressurized gas mass flow may then convey paintballs in the tube 144 through the seal 26 and may propel paintballs from the tube 220 into the hollow interior portion 222 of the hopper 214.

Figure 31:
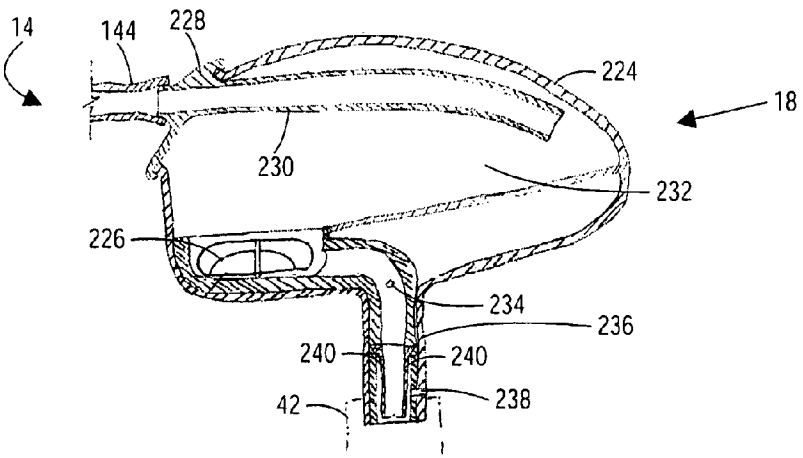
FIG. 31 is a cross sectional view of a portion of an exemplary embodiment of the paintball system shown in FIG. 1.

As shown in FIG. 31, the conduit 18 may include a hopper 224, which may include a pump 226. The gas supply 44 (FIG. 21), the container 142 (FIG. 21), and the tube 144 (FIG. 21)

may be coupled to the hopper 224 using an adapter 228. If desired, the adapter 228 may form part of the hopper 224. The adapter 228 may include a tube 230 sized and configured to contain and transmit paintballs, preferably in a single-file line. The tube 230 preferably extends into a hollow interior portion 232 of the hopper 224. The hopper 224 may also include a paintball sensor 234 configured to trigger the activation of the pump 226. The hopper 224 also may include an outlet tube 236, which may be coupled to the fill tube 42 of the marker 12.

The pump 226 and the gas supply may be activated to begin use of the paintball system. As described above, once the gas supply 44 is activated, the gas supply may be left activated throughout play. In response to activation of the gas supply, pressurized gas flows through the container 142, through the tube 144, through the adapter 228, and through the hopper 224—moving the paintballs in those components toward the breech 30 of the marker 12. The conduit 18 may include a vent sized and configured to allow the pressurized gas to escape. For example, the hopper 224 may include a vent 238. If desired, the fill tube 42 or other portion of the marker 12 may include a vent sized and configured to allow the pressured gas to escape. In addition, a portion of the conduit 18 (such as the hopper) and a portion of the marker 12 (such as the fill tube 42) may be sized and configured to form a vent between them when connected, which may also allow the pressurized gas to escape.

As shown in FIG. 31, the hopper 224 may house a seal 240. For example, the outlet tube 236 may house the seal 240. The seal 240 may be sized and configured to allow easy passage of paintballs from the outlet tube 236 to the fill tube 42 en route to the breech 30. The seal 240 may also be sized and configured to form a seal with at least one paintball. For example, when the paintball supply exceeds the demand of the marker 12, paintballs may backup from the breech 30 through the fill tube 42 and into the outlet tube 236 to the point where at least a portion of at least one paintball forms a seal with the seal 240. In addition, when the paintball supply exceeds the demand of the hopper 224, paintballs may backup from a jumbled arrangement of paintballs at the end of the tube 230 through the adapter 228 and into the tube 144—which may help prevent or reduce the risk of overfilling and/or clogging the hopper 224.

As shown in FIG. 31, the seal 240 preferably comprises a sleeve. The seal 240 is also preferably constructed from an elastomeric material. It will be appreciated, however, that the seal 240 need not comprise a sleeve and that the seal 240 may comprise a sleeve, a washer, an O-ring, a protrusion (such as a lip) and/or other suitable structures having other suitable sizes, shapes, and/or configurations. It will also be appreciated that the seal 240 may be constructed from other suitable materials having other suitable properties.

When the seal 240 forms a seal with at least one paintball, the pressure tends to increase in the portion of the conduit 18 between the inline pressure regulator 52 and the seal 240. As the pressure increases in the portion of the conduit 18 between the inline pressure regulator 52 and the seal 240, the inline pressure regulator 52 may slow the gas flow into the conduit and may eventually stop the gas flow into the conduit when that pressure reaches a desired maximum pressure limit.

As the marker 12 resumes firing paintballs, the last paintball that formed a seal with the seal 240 may move forward. This movement forward may open a path to atmosphere for the pressurized gas in a portion of the conduit 18, such as the pressurized gas in the portion of the conduit between the inline pressure regulator 52 and the seal 240. Consequently, the pressurized gas mass flow may resume from the tube 144, through the adapter 228, through the hopper 224 and out the vent 238 to the atmosphere. The resulting pressurized gas mass flow may then convey paintballs in the tube 144, through the tube 230, and into the hollow interior portion 232 of the hopper 224. The resulting pressurized gas mass flow may also help convey paintballs in the outlet tube 236 through the seal 240 towards the breech 30 of the marker 12 to allow the marker to continue firing paintballs.

The delivery system 14 shown in FIG. 31 may use breech loading that uses both mechanical-contact-pushing of the pump 226 on a stack of paintballs between the breech and the pump, and pressure based pushing on the portion of the stack of paintballs between the breech and the seal 240. Advantageously, this may help provide both relatively rapid and generally consistent breech loading. In addition, the delivery system 14 as shown in FIG. 31 may advantageously help keep the hopper 224 sufficiently filled with paintballs throughout the duration of a paintball game.

Figure 32:
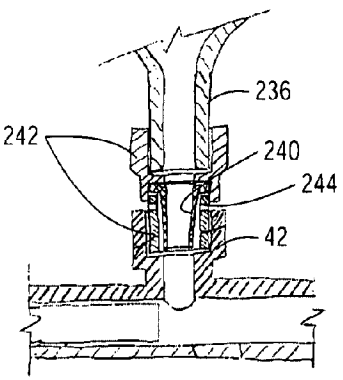
FIG. 32 is a cross sectional view of a portion of an exemplary embodiment of the paintball system shown in FIG. 1.

As shown in FIG. 32, the seal 240 may be positioned in other suitable locations. In particular, the conduit 18 may also include a housing 242, which may house the seal 240 instead of the outlet tube 236 of the hopper 224. The housing 242 may be connected to the outlet tube 236 and the fill tube 42 of the marker 12 in any suitable fashion. Preferably, the housing 242 may be selectively connected and disconnected from the hopper 224 and the marker 12, which may allow the hopper 224 be used with (or without) the gas supply 44, the tube 144, and/or other portions of the delivery system 14.

In addition, the hopper 224 and the seal 240 (with or without the housing 242) may be used in a variety of other contexts. For example, a gas supply need not propel paintballs to the hopper. In particular, by merely providing pressurized gas to the hopper 224, the gas supply may help provide pressure-based and/or mechanical-push-based breech loading. The gas supply may be a local, marker mounted gas supply or a remote gas supply, if desired. An exemplary remote gas supply may include the gas supply 44 as shown in FIG. 28, which may be coupled to the hopper 224 using a tube and a suitable adapter. An exemplary marker-mounted gas supply may include a relatively small carbon dioxide canister or a supply line that taps into the gas supply 38 of the marker 12. If desired, the activation of the gas supply may be linked to a sensor configured to detect when a lid of the hopper 224 is closed, and the activation is possible only when the lid is closed.

The marker 12 may be configured to be connected to (and/or form part of) a conduit sized and configured to contain and/or transmit paintballs to the marker's breech 30. For example, as shown in FIG. 33, the conduit 18 may be sized and configured to contain and/or transmit paintballs to the breech 30 of the marker 12, and at least a portion of the conduit may be formed by the marker.

Figure 33:
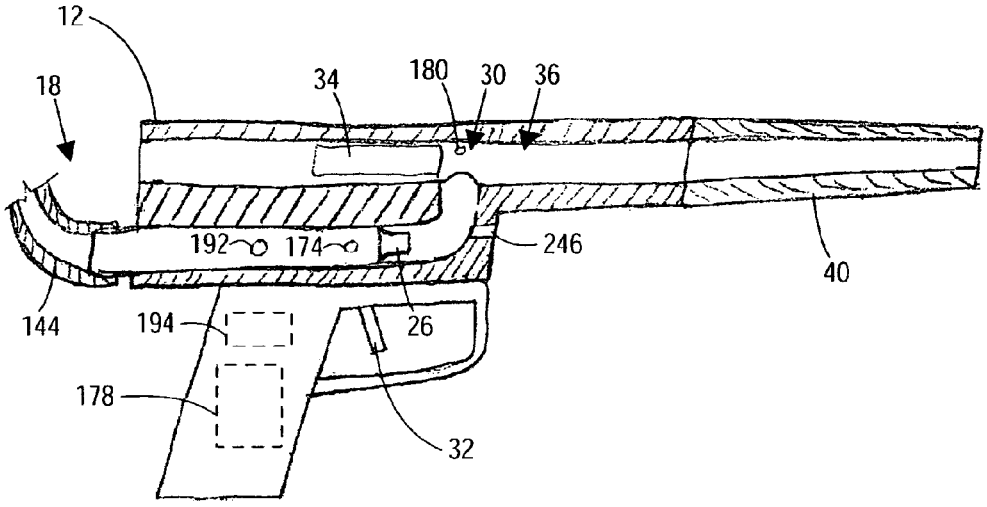
FIG. 33 is a cross sectional view of a portion of an exemplary embodiment of the paintball system shown in FIG. 1.

The gas supply 44 (FIG. 21), the container 142 (FIG. 21), and the tube 144 (FIG. 21) may be coupled to the marker 12 shown in FIG. 33. The pump 154 (FIG. 23) and the gas supply 44 may be activated to begin use of the paintball system. As described above, once the gas supply 44 is activated, the gas supply may be left activated throughout play. In response to activation of the gas supply, pressurized gas flows through the container 142, through the tube 144 and into the marker 12—moving the paintballs in those components toward the marker's breech 30. The marker 12 may include a vent 246 sized and configured to allow the pressurized gas to escape.

When the paintball supply exceeds the demand of the marker, paintballs may backup from the breech 30 in a single file line to the point where at least a portion of at least one paintball forms a seal with the seal 26. As described above, when the seal 26 forms a seal with at least one paintball, the pressure tends to increase in the portion of the conduit 18 between the inline pressure regulator 52 and the seal 26. As the pressure increases in the portion of the conduit 18 between the inline pressure regulator 52 and the seal 26, the inline pressure regulator 52 may slow the gas flow into the conduit and may eventually stop the gas flow into the conduit when that pressure reaches a desired maximum pressure limit.

At that point, when the inline pressure regulator stops the gas flow into the conduit, the flow of paintballs 16 within the conduit 18 may slow to a halt. As the marker 12 resumes firing paintballs, the last paintball that formed a seal with the seal 26 may move forward. This movement forward may open a path to atmosphere for the pressurized gas in a portion of the conduit 18, such as the pressurized gas in the portion of the conduit between the inline pressure regulator 52 and the seal 26. Consequently, the pressurized gas mass flow may resume from the tube 144, through marker 12 and out the marker's vent 246 to the atmosphere. The resulting pressurized gas mass flow may rapidly convey paintballs in the tube 144 through the seal 26 and to the breech 30 of the marker 12 to allow the marker to continue firing paintballs. In addition, the resulting pressurized gas mass flow may help replenish the paintball supply in the tube 144 with the paintballs in the container 142.

As shown in FIG. 33, the portion of the conduit 18 formed by the marker 12 may include the sleeve 26 (FIG. 25) and the sensors 174, 180 (FIG. 25). As described above, the programmable trigger control module 178 may use the sensors 174, 180 in determining how to control the firing of the marker 12.

As shown in FIG. 33, the marker 12 may include a gas bleed 192. The gas bleed 192 is preferably positioned upstream from (and/or adjacent to) the sleeve 26. Advantageously, the sensor 174 may be used to control the gas bleed 192. In particular, the marker may include the bleed control module 194 (FIG. 27), which may activate the gas bleed 192 in response to the sensor 174 detecting the absence of the paintball. By activating the gas bleed 192, pressurized gas flows through the conduit 18 and out the gas bleed to the atmosphere—which may help advance paintballs in the conduit toward the seal 26 and close any gaps there between.

Figure 34:
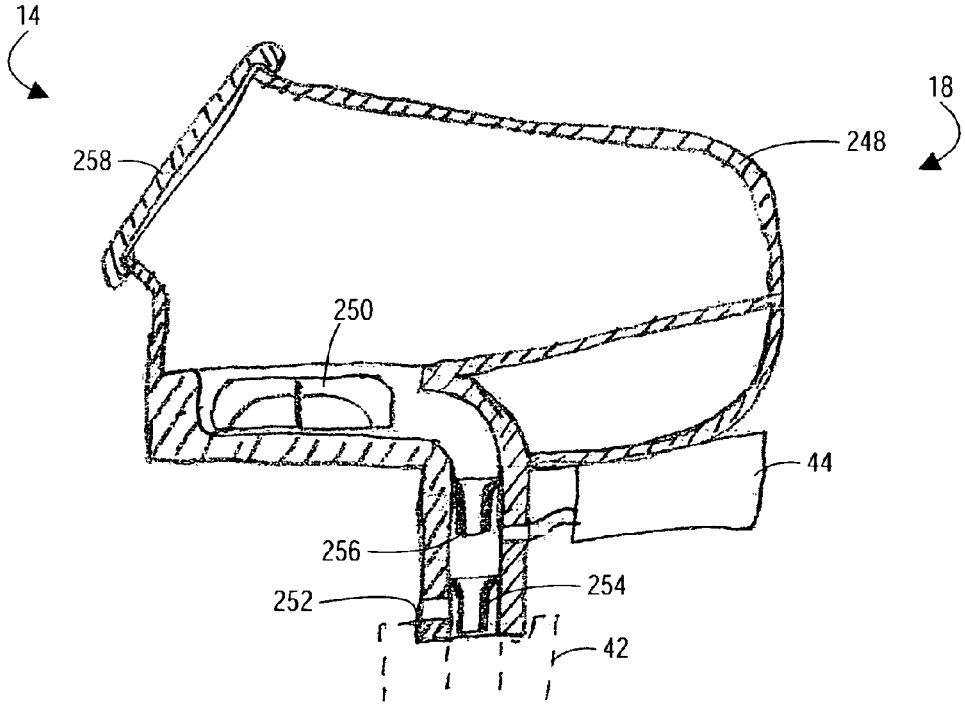
FIG. 34 is a cross sectional view of a portion of an exemplary embodiment of the paintball system shown in FIG. 1.

As shown in FIG. 34, the conduit 18 may include a hopper 248. The hopper 248 may include a pump 250, a vent 252, a seal 254, a seal 256 and a lid 258. The seal 254 may be sized and configured to form a seal with at least one paintball; and the seal 256 may be sized and configured to form a seal with at least one paintball. For example, the pump 250 may push paintballs toward the breech 30 of the marker. When the paintball supply exceeds the demand of the marker 12, paintballs may stack up from its breech 30 in a single file line, through its fill tube 42, and to the point where at least one paintball forms a seal with the seal 254 and at least one paintball forms a seal with the seal 256. When the marker 12 is fired, the pump 250 preferably pushes the stack of paintballs toward the breech about the distance of one paintball such that the seals 254, 256 again form seals with at least one paintball.

The seals 254, 256 preferably comprise a sleeve. The seals 254, 256 are also preferably constructed from an elastomeric material. It will be appreciated, however, that the seal 254, 256 need not comprise a sleeve and that the seals 254, 256 may comprise a sleeve, a washer, an O-ring, a protrusion (such as a lip) and/or other suitable structures having other suitable sizes, shapes, and/or configurations. It will also be appreciated that the seals 254, 256 may be constructed from other suitable materials having other suitable properties.

A gas supply 44 may provide gas flow into the hopper 248. In one embodiment, the gas supply 44 may comprise a relatively lightweight gas container containing carbon dioxide, which may be mounted to the hopper 248 and/or to the marker 12. It will be appreciated, however, that the gas supply 44 need not be mounted to the hopper 248 or the marker 12 and that the gas supply 44 may comprise any other suitable gas supply.

As shown in FIG. 34, the gas supply 44 may provide gas flow, which may increase pressure between a first seal and a second seal—the first seal being formed by the seal 254 and at least one paintball, and the second seal being formed by the seal 256 and at least one paintball. Consequently, the delivery system 14 shown in FIG. 34 may use breech loading that uses both mechanical-contact pushing of the pump 250 on a stack of paintballs between the breech and the pump, and pressure-based pushing on the portion of the stack of paintballs between the breech and the seal 254. Advantageously, this may help provide both relatively rapid and generally consistent breech loading.

As shown above, the seal 256 advantageously helps to sustain pressure upstream from seal 254, which may advantageously provide a pressure based pushing on a stack of paintballs. It will be appreciated that the hopper may be sized and configured to sustain such pressure without the seal 256, for example, when the lid 258 is sufficiently air tight.

As discussed above, the conduit 18 may include one or more portions that define passageways, which passageways are preferably sized and configured to help contain and/or transmit paintballs. For example, the tubes 20, 64, 66, 70, 74, 144, 148, 188, 200, 220, 230; the containers 78, 94, 114; and/or other portions of the conduit 18 may define passageways that may have generally circular cross sections, which may advantageously help contain and/or transmit paintballs. The diameters of the passageways are preferably sized and configured to arrange paintballs in a single file line. In addition, the diameters of the passageways are preferably sized and configured to tolerate certain varying diameters of the paintballs; however, it will be appreciated that the clearance between the paintballs and walls of the passageways may affect the mass flow rate used in the paintball system 10. For example, a larger clearance may require a greater mass flow rate to move paintballs, whereas a lesser clearance may require a lesser mass flow to move paintballs. Thus, lower pressurized gas consumption may advantageously be realized with lesser clearance. In one embodiment, the passageways preferably have a diameter between about 0.74 to about 0.76 inches to accommodate 68-caliber paintballs. It will be appreciated, however, that other diameters may be used with 68-caliber paintballs. It will also be appreciated that paintballs need not be 68-caliber and that paintballs may have other suitable sizes. It will be further appreciated that the passageways may have a generally circular, oblong, oval, polygonal or other cross section having other suitable sizes, shapes and configurations.

The tubes 20, 64, 66, 70, 74, 144, 148, 188, 200 may be relatively strong and durable. For example, the tubes 20, 64, 66, 70, 74, 144, 148, 188, 200 preferably include a spiral wound reinforcement construction, which may be relatively flexible yet may help reduce diameter constriction when flexed. The passageways of the tubes 20, 64, 66, 70, 74, 144, 148, 188, 200 may also be lined with a friction-reducing substance, such as TEFLON®, lubricants, or the like. It will be appreciated, however, that the tubes 20, 64, 66, 70, 74, 144, 148, 188, 200 do not require any friction reducing substances and may have any suitable construction having other suitable characteristics.

It will be appreciated that aspects of the embodiments disclosed above may be modified. For example, a single, actively controlled mass flow component could be configured to function as the mass flow rate control 50 and a pressure regulator (such as, the inline pressure regulator 50 or the pilot pressure regulator 52); and the mass flow component could control the pressurized gas mass flow based on, for example, the gauge pressure at an outlet of the container 142, other containers or any other suitable portion of the conduit 18. Also for example, the gas container 46 could be replaced with an air pump, which preferably would be portable. The air pump could have variable speed, which could be controlled to attain appropriate gas flow rates based on, for example, the gauge pressure at an outlet of the container 142, other containers or any other suitable portion of the conduit 18. Accordingly, it will be appreciated that a gas supply does not require the valve 48, the mass flow rate control 50, or a pressure regulator (such as, the inline pressure regulator 50 or the pilot pressure regulator 52).

It will be appreciated that the paintball system 10 may be used with a variety of suitable projectiles. For example, the paintball system 10 may be used to fire reusable projectiles that are configured to be fired and reused several times without breaking. These reusable projectiles may advantageously be used when marking with paintballs is not required or desired. In particular, players may use the reusable projectiles during team practices. In addition, marker manufacturers may use the reusable projectiles to conduct tests to demonstrate to their consumers that their marker has a superior firing rate. Exemplary reusable projectiles include REBALL RENTAL REBALLS, which are commercially available from Reball US, having offices at 655 West Grand Avenue, Suite 360, Elmhurst, Ill., 60126, USA. The REBALL RENTAL REBALLS are desirably configured to be reused over 600 times; however, it will be appreciated that reusable projectiles may be configured to be reused any other suitable number of times. It will also be appreciated that the paintball system 10 need not be used with REBALL RENTAL REBALLS and may be used with other reusable projectiles.

Although this invention has been described in terms of certain preferred embodiments, other embodiments apparent to those of ordinary skill in the art are also within the scope of this invention. Accordingly, the scope of the invention is intended to be defined only by the claims which follow.

The invention claimed is:

1. A paintball system for providing paintballs to a marker, the marker including a barrel and a breach, the paintball system comprising:

a conduit for transmitting a plurality of paintballs, the conduit including an inner circumference larger than an outer circumference of a paintball of the plurality of paintballs to allow the plurality of paintballs to relatively freely move within the conduit;

a gas supply for providing gas flow to the conduit;

a first seal positioned downstream from the gas supply and upstream from the barrel and the breach, the first seal sized and configured to form a seal with a paintball of the plurality of paintballs;

an engagement surface of the first seal that at least partially engages a paintball of the plurality of paintballs, the seal including an inner circumference smaller than the outer circumference of the paintball of the plurality of paintballs to at least partially restrict movement of the plurality of paintballs and at least partially form an airtight seal with the paintball, the seal formed with the paintball causing an increase in pressure downstream from the gas supply and upstream from the first seal, the gas supply being configured to at least substantially stop gas flow into the conduit in response to the increased pressure caused by the seal formed with the paintball reaching a predetermined pressure; and a connector for connecting the system to a marker.

2. The paintball system as in claim 1, wherein the first seal comprises a sleeve, the sleeve sized and configured to form the seal with the paintball that causes the increased pressure.

3. The paintball system as in claim 1, wherein the gas supply comprises an inline pressure regulator configured to at least substantially stop gas flow into the conduit in response to the increased pressure caused by the seal formed with the paintball reaching the predetermined pressure.

4. The paintball system as in claim 1, further comprising:

a sensor that measures a velocity of at least one of the paintballs; and a mass flow rate control that is configured to dynamically alter the gas flow to the conduit in response to the measured velocity of at least one of the paintballs.

5. The paintball system as in claim 1, further comprising at least one paintball sensor positioned upstream from the first seal.

6. The paintball system as in claim 1, wherein the gas supply is configured to provide a mass-flow-limited and pressure-regulated gas flow to the conduit.

7. A system for transmitting paintballs to an apparatus such as a marker including a breach and a barrel, the paintball system comprising:

a conduit sized and configured to align a plurality of paintballs in a single-file line, the conduit including an inner circumference larger than an outer circumference of a paintball of the plurality of paintballs to allow the plurality of paintballs to relatively freely move within the conduit; a gas supply configured to provide gas flow to the conduit;

a first seal positioned downstream from the gas supply and upstream from the apparatus, the first seal including an engagement surface sized and configured to form a seal with a first paintball of the plurality of paintballs, the engagement surface including an inner circumference smaller than the outer circumference of the paintball of the plurality of paintballs to at least partially form an airtight seal with the paintball, the first paintball being positioned upstream from a second paintball of the plurality of paintballs, the seal formed with the first paintball causing an increase in pressure downstream from the gas supply and upstream from the first seal, the gas supply being configured to at least substantially stop gas flow into the conduit in response to the increased pressure caused by the seal formed with the first paintball reaching a predetermined pressure; and a connector disposed downstream from the gas supply, the connector configured to connect the system to a marker.

8. The paintball system as in claim 7, wherein the second paintball is positioned to resist the downstream movement of the first paintball.

9. The paintball system as in claim 7, further comprising a sensor configured to detect if a third paintball of the plurality of paintballs is positioned upstream from the first paintball.

10. The paintball system as in claim 9, further comprising a marker including a trigger control module configured to control the firing of the marker, the trigger control module being configured to, in response to the sensor detecting that a third paintball is not positioned upstream from the first paintball, adjust the timing of the firing of the marker.

11. The paintball system as in claim 9, further comprising a marker including a trigger control module configured to control the firing of the marker, the trigger control module being configured to, in response to the sensor detecting that a third paintball is positioned upstream from the first paintball, adjust the timing of the firing of the marker.

12. The paintball system as in claim 7, wherein at least a portion of the conduit is disposed in a marker; and wherein at least a portion of the first seal is positioned in the portion of the conduit disposed in the marker.

13. A system for delivering paintballs to a marker, the marker including a barrel and a breach, the system comprising:

a conduit that is sized and configured to allow one or more paintballs to move within the conduit, the conduit including a first end for receiving paintballs and a second end for providing paintballs to a marker, the conduit including an inner circumference larger than an outer circumference of a paintball of the plurality of paintballs to allow the plurality of paintballs to relatively freely move within the conduit;

a gas supply connected to the conduit, the gas supply supplying a pressurized gas to at least a portion of the conduit; and a seal positioned upstream of the barrel and the breach and at least partially disposed within the conduit and extending inwardly from an inner surface of the conduit, the inwardly extending seal including an inner circumference smaller than the outer circumference of the paintball of the plurality of paintballs to at least partially form an airtight seal with the paintball, the seal including a surface contacting at least one of the paintballs within the conduit to form a higher pressure side and a lower pressure side, the seal being sized and configured to allow paintballs to pass through the seal from the higher pressure side to the lower pressure side.

14. The system as in claim 13, wherein the conduit includes a container that is sized and configured to hold a plurality of paintballs, the pressurized gas from the gas supply being supplied to the container.

15. The system as in claim 13, wherein the conduit includes a tube that is sized and configured to hold a plurality of paintballs, at least a portion of the tube receiving the pressurized gas from the gas supply.

16. The system as in claim 13, wherein the conduit is connected to a feed tube of the marker.

17. The system as in claim 13, wherein the conduit is connected to a hopper of the marker.

18. The system as in claim 13, wherein the gas supply includes a valve and a regulator to control the pressurized gas flowing into the conduit, the flow of pressurized gas being increased to increase a speed of the paintballs within the conduit, the flow of pressurized gas being decreased to decrease the speed of the paintballs within the conduit.

19. The system as in claim 13, wherein the seal is sized and configured to allow a paintball to pass through the seal when there is a sufficient pressure differential between the higher pressure side and the lower pressure side.

* * * * *